US010934678B2

(12) United States Patent
Dekle et al.

(10) Patent No.: US 10,934,678 B2
(45) Date of Patent: Mar. 2, 2021

(54) PRESSURE GROUTED DISPLACEMENT SCREW PILES

(71) Applicant: APTIM INTELLECTUAL PROPERTY HOLDINGS, LLC, Baton Rouge, LA (US)

(72) Inventors: Carl Dekle, Mobile, AL (US); Scott Slaughter, Baton Rouge, LA (US); Robert Forsythe, Baton Rouge, LA (US); Raja Madhyannapu, Baton Rouge, LA (US); Firouz Rosti, Baton Rouge, LA (US)

( * ) Notice: Subject to any disclaimer, the term of this patent is extended or adjusted under 35 U.S.C. 154(b) by 0 days.

(21) Appl. No.: 16/970,924

(22) PCT Filed: Feb. 28, 2019

(86) PCT No.: PCT/US2019/020122
§ 371 (c)(1),
(2) Date: Aug. 18, 2020

(87) PCT Pub. No.: WO2019/169180
PCT Pub. Date: Sep. 6, 2019

(65) Prior Publication Data

US 2021/0017728 A1 Jan. 21, 2021

Related U.S. Application Data

(60) Provisional application No. 62/636,648, filed on Feb. 28, 2018.

(51) Int. Cl.
*E02D 5/46* (2006.01)
*E02D 5/28* (2006.01)
(Continued)

(52) U.S. Cl.
CPC ..... *E02D 5/46* (2013.01); *E02D 5/285* (2013.01); *E02D 5/523* (2013.01); *E02D 5/56* (2013.01);
(Continued)

(58) Field of Classification Search
CPC combination set(s) only.
See application file for complete search history.

(56) References Cited

U.S. PATENT DOCUMENTS 5,256,004 A 10/1993 Gemmi et al.
5,904,447 A 5/1999 Sutton et al.
(Continued)

FOREIGN PATENT DOCUMENTS

CN 206308687 U 7/2017
KR 101731536 B1 4/2017
WO 2000/036226 A2 6/2000

OTHER PUBLICATIONS

International Search Report, dated May 7, 2019, for Appl. No. PCT/US19/20122, filed Feb. 28, 2019.
(Continued)

*Primary Examiner* — Kyle Armstrong
(74) *Attorney, Agent, or Firm* — AdamsIP, LLC; J. Hunter Adams; Stephen Thompson

(57) ABSTRACT

A grouting module may include a lower surface configured for connection to a screw pile component, an upper surface configured for connection to an upper hollow pile shaft, a body disposed between the upper surface and the lower surface, and an axial bore through the upper surface and at least a portion of the body. The body may include a flange configured to create an annular space around the upper adapter and one or more flow injection conduits configured for injecting grout received from the upper hollow pile shaft through the axial bore extension into the annular space while
(Continued)

the pile is advanced downward into a substrate. Once the final pile tip elevation is reached, the pile extensions above the grouting module are counter-rotated slightly to realign the ports in the grouting module from side to bottom discharge and allow post-grouting of the lead pile extension.

14 Claims, 17 Drawing Sheets

(51) Int. Cl.
*E02D 5/52* (2006.01)
*E02D 5/80* (2006.01)
*E02D 5/56* (2006.01)

(52) U.S. Cl.
CPC ..... *E02D 5/801* (2013.01); *E02D 2250/003* (2013.01); *E02D 2600/20* (2013.01)

(56) References Cited

U.S. PATENT DOCUMENTS

| | | | | |
|---|---|---|---|---|
| 6,652,195 | B2 | 11/2003 | Vickars et al. | |
| 9,051,706 | B1 | 6/2015 | Ludwig | |
| 9,416,513 | B2 * | 8/2016 | Kemp | E21B 10/42 |
| 2003/0044241 | A1 | 3/2003 | Mure et al. | |
| 2009/0155000 | A1 | 6/2009 | Happel et al. | |
| 2015/0117960 | A1 | 4/2015 | Kemp et al. | |

OTHER PUBLICATIONS

Written Opinion of the International Searching Authority, dated May 7, 2019, for Appl. No. PCT/US19/20122, filed Feb. 28, 2019.

* cited by examiner

PRESSURE GROUTED DISPLACEMENT SCREW PILES

CROSS-REFERENCE TO RELATED APPLICATIONS

This application is a United States National Stage Application of PCT/US19/20122, filed Feb. 28, 2019, which application claims benefit, under 35 U.S.C. § 119, of U.S. Provisional Application Ser. No. 62/636,648 filed on Feb. 28, 2018, both applications entitled "Pressure Grouted Displacement Screw Piles" and incorporated herein by reference in their entirety.

FIELD OF THE DISCLOSURE

The subject matter of the present disclosure refers generally to pressure grouted displacement screw piles and methods of installing pressure grouted displacement screw piles.

BACKGROUND

Piles are commonly used to provide positive foundation support at sites having poor soil conditions by transferring foundation loadings to more competent materials encountered at deeper depths. Foundation piles can be placed into two general categories: displacement and non-displacement piles. Displacement piles (such as driven piles) are analogous to driving a nail into a piece of wood using a hammer in that the soil is displaced laterally by the pile in order for reach the desired pile tip depth. On the other hand, non-displacement piles (such as auger cast piles) are analogous to drilling a hole into a piece of wood and inserting a nail. Due to their nature, displacement piles will generally have a higher capacity to support foundation loadings than an equivalent sized non-displacement pile.

Both displacement and non-displacement piles usually require a large crane and other related equipment in order to install the piles into the soil. Such large equipment can be rather expensive and also create significant safety concerns to personnel and adjacent equipment and structures due to overhead hazards. For example, raising a 120 feet length concrete or steel pipe pile into the pile leads in preparation for driving can create a significant safety risk.

Screw piles, which may also be called helical piles, are a specialized foundation type involving one or more auger flights that are attached to an initial pile extension usually comprised of steel pipe. A hydraulic auger motor (usually mounted on an excavator) is then attached to the top of the pile extension in order to apply sufficient torque to turn the entire auger flight assembly and cause the pile to advance downward into the soil. Additional pile extensions are then attached to the top of the pile as needed and the torque process repeated until the desired pile tip depth is obtained.

Screw piles offer many distinct advantages over other pile types, such as: little or no vibrations or noise during pile installation, little or no spoils produced, and no need for large pile installation equipment (such as a crane) that create significant overhead hazard concerns. However, due to the nature of screw piles and the fact that the pipe extensions of the pile are generally of considerably smaller diameter than the auger flight diameter(s), this can result in decreased side friction of the soil along the pile shaft and affect the overall pile load carrying capacity. What is needed is an improved screw pile type with increased soil-pile interaction capabilities in order to increase the overall pile capacity and load-carrying performance.

SUMMARY OF THE DISCLOSURE

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments of the present disclosure relate to a grouting module which may include a lower adapter configured for connection to a screw pile component, an upper adapter configured for connection to an upper hollow pile shaft, a body disposed between the upper and lower adapters, and an axial bore through the upper surface and at least a portion of the body. The body may include a widened flange configured to create an annular space around the upper adapter and one or more flow injection conduits configured for injecting cementitious grout or other flowable material received from the upper hollow pile shaft through the axial bore extension into the annular space while the pile is advanced downward into a substrate.

In another aspect, embodiments of the present disclosure relate to a screw pile system which may include: one or more hollow pile shaft extensions, a grouting module, and a lead pile extension having auger flights disposed thereon to advance the pile into the soil. The grouting module may include a flange, to create an annular space around the one or more shaft extensions, and may be configured to direct flow of grout out of the module to fill the annular space. One or more hollow pile shaft extensions may be connected to an upper adapter of the grouting module. The auger shaft extension may be connected to a lower adapter of the grouting module. The upper and lower adapters allow for versatility of the grouting module to be incorporated to a wide range of screw pile designs and configurations.

In another aspect, embodiments of the present disclosure relate to a method of installing a pile including the following steps: advancing a lead pile extension into a substrate at a pile location, connecting a lower surface of a grouting module to a proximal end of an auger extension, connecting a pile shaft extension to an upper surface of the grouting module, advancing the pile extension, the grouting module, and the lead extension into the substrate, and flowing grout through the pile shaft extensions and the grouting module, such that the grout flows out of the grouting module and fills the annular space. The grouting module may include an axial bore and a tapered outer surface configured to create an annular space around an upper portion of the grouting module.

In one aspect, embodiments of the present disclosure relate to a grouting module which may include a tubular body having an upper portion and a lower portion and an axial bore through at least a portion of the tubular body. The lower portion may include a tapered outer surface having an outermost diameter greater than the outermost diameter of the upper portion. The grouting module may further include one or more outlets fluidly connected to the axial bore and configured to direct flow from the axial bore to an exterior of the grouting module above the tapered outer surface, and a check valve disposed within the axial bore. Further, the grouting module may have a system that allows for realignment of the side and bottom ports through counter-rotation of the pile string after the pile is advanced.

In another aspect, embodiments of the present disclosure may relate to a grouting module which may include a lower surface configured for connection to a screw pile component, an upper portion configured for connection to an upper hollow pile shaft, one or more flow injection conduits for conveying grout received from the upper hollow pile shaft into an annular space formed above the grouting module as the pile is advanced downward into a substrate, and a check valve configured to allow unidirectional flow outward through the grouting module.

In some embodiments, a check valve within the grouting module may prevent backflow of grout into the body and maintains pressure of the grout in the annular space during the pile installation process minimizing the potential for necks or thinning of the grout section surrounding the pile shaft. The pressurized grout also compresses and densifies the surrounding soils laterally.

In some embodiments of a method as disclosed herein, once the desired pile tip depth is reached, the upper pile extensions are then rotated slightly in the direction opposite needed to advance the pile into the soil. The reverse rotation allows the ports in the grouting module to realign from side discharge into the annular space around the pile shaft to the bottom discharge so that grout may be injected through the ports in the lead extension containing the auger flights. Grout is then injected into the lead extension to densify and strengthen the soils surrounding the auger flights and pile tip. This allows for an increase in the soil side friction along the pile shaft and strengthening of the supporting soils around the auger flights and pile tip and an increase in the overall load carrying capability of the pile type over conventional screw piles.

Other aspects and advantages will be apparent from the following description and the appended claims.

BRIEF DESCRIPTION OF THE DRAWINGS

These and other features, aspects, and advantages of the present disclosure will become better understood with regard to the following description, appended claims, and accompanying drawings where:

DETAILED DESCRIPTION

Figure 1A:
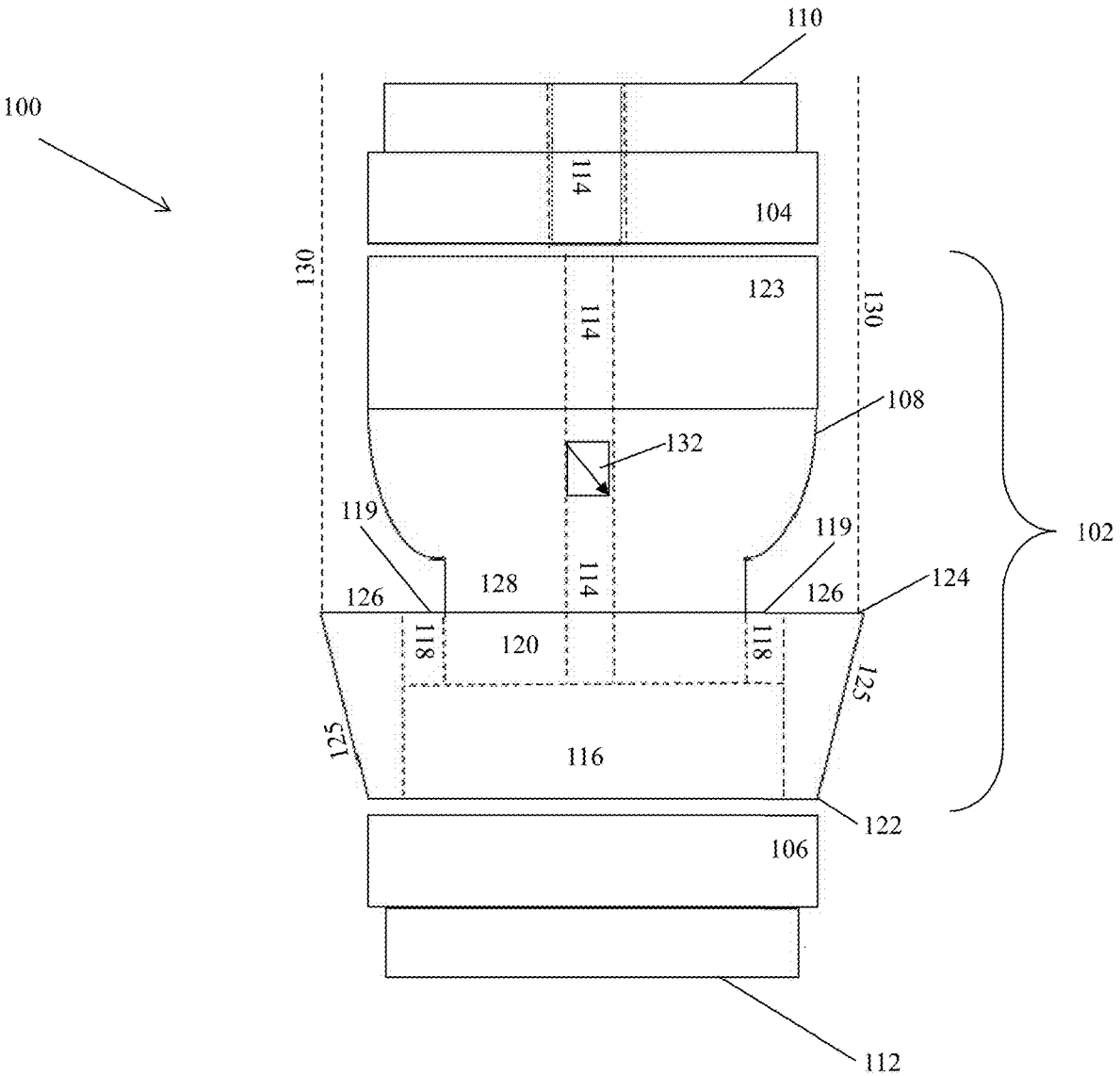
FIG. 1*a* is a cross-section view of a grouting module in accordance with the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

As used herein, the term "coupled" or "coupled to" or "connected" or "connected to" may indicate establishing either a direct or indirect connection, and is not limited to either unless expressly referenced as such.

Embodiments of the present disclosure relate to pressure grouted screw piles and systems and methods for their formation. Pressure grouted screw piles herein may be screw foundation piles having a layer of grout disposed around an outer surface of the pile shaft, having a compressed substrate therearound, and where the grout is injected at elevated pressures during installation of the pile. The pressure grouted screw pile may be installed into the substrate at a pile location via rotation. The substrate may be compressed and densified as the screw pile is advanced into the substrate, using grouting modules according to embodiments herein, forming an annular space around the screw pile shaft. Grout may be injected through the screw pile and grouting module and into the annular space, at depth as the screw pile is advanced, at an elevated pressure, such that a relatively uniform grouting is achieved around the pile shaft.

The present disclosure thus relates to, without limitation, a pressure grouted screw pile, a grouting module, a method for maintaining grout pressure in and around the pile shaft during installation, a system for installing a pressure grouted screw pile, and a method of installing a pressure grouted screw pile.

The pressure grouted screw pile of the present disclosure may provide advantages over piles which are currently used. The pressure grouted screw pile may be installed using a conventional skid-steer or excavator with an auger motor attached, and a boom of the skid-steer or excavator may only have to be raised to a sufficient height to accommodate the pile section to be advanced, generally less than about ten feet. This installation process may be less time-consuming and safer, and may require less equipment than conventional piles. Additionally, because the pressure grouted screw pile is pressure grouted around the pile shaft, the installed pile may provide increased load carrying capabilities. Because the pressure grouted screw pile is a screw pile, it may also have advantages over currently used screw piles. Namely, the pressure grouted screw pile may have a greater compressive capacity than traditional screw piles by providing an increase in pile load carrying capacity through increased side friction along the pile shaft and end-bearing around the bottom pile section and tip. Thus, pressure grouted screw piles herein may provide the advantages of both traditional screw piles and other pile types.

Grouting modules according to embodiments herein may be used in a screw pile system and may be positioned in a lower pile extension and one or more upper pile extension. The grouting module may include an external structure configured to compress the substrate laterally as the pile is advanced into the soil, thereby forming an annulus around the shaft of the upper pile extension. The grouting module may also include an internal bore and a distribution system to pressure inject grout pumped through the upper pile extension into the annulus formed around the upper pile extension as the pile is advanced downward into the soil. The grouting module may thus be used to install a pressure grouted screw pile. The grouting module may compress and densify the substrate around the grouting module to form an annular space around the screw pile shaft and may inject grout into the annular space.

The grouting module may comprise an outer surface which is configured to compress and/or densify the substrate surrounding the grouting module, as the grouting module is advanced into the substrate. For example, the outer surface of the grouting module may include an outward sloped or tapered surface, extending outward from the outermost diameter of the pile shaft. The outward sloped or tapered surface may extend outward a distance sufficient to compress, densify, and/or compact soil or substrate displaced by the pile shaft or disturbed by the auger flights of the pile. The resulting compaction of the substrate and the continued advancement of the screw pile may thus provide an annular space intermediate between the substrate and the pile shaft. In some embodiments, the outer surface may be formed by a flanged component along the pile shaft or may be formed integral to the grouting module.

The grouting module may include internal flow bores. The flow bores may be configured such that grout may be pumped into the grouting module through the hollow upper piles, may flow through the grouting module, and may be injected from the grouting module into the annular space around the pile shaft as the pile is being advanced. The grout may be injected into the annular space formed above the grouting module as it advances, and in such embodiments, the axial bore may extend to/intersect the upper adapter of the grouting module, such that grout may flow into the grouting module through the upper surface. The axial bore may extend to the lowermost pile sections allowing grout to flow through the lowermost ports near the helices as well as flow into the annular space created around the pile shaft. Alternately, the axial bore may not extend to/intersect the lower adapter of the grouting module, thereby directing the flow of grout through flow channels within the grouting module and into the annular space formed during advancement of the screw pile.

The distribution system for injecting grout into the annular space formed behind the outward tapered surface, may be configured to direct a flow of grout through one or more outlets at a flowrate sufficient to fill the volume of the annular space as it is being formed. The grouting module additionally transmits the torque from the upper piles to the screw pile, and thus the distribution system is configured to provide distribution of the grout while connecting the upper and lower adapters of the grouting module, where the connection provides sufficient strength for the expected loads and torque that may be encountered during pile installation.

Figure 1B:
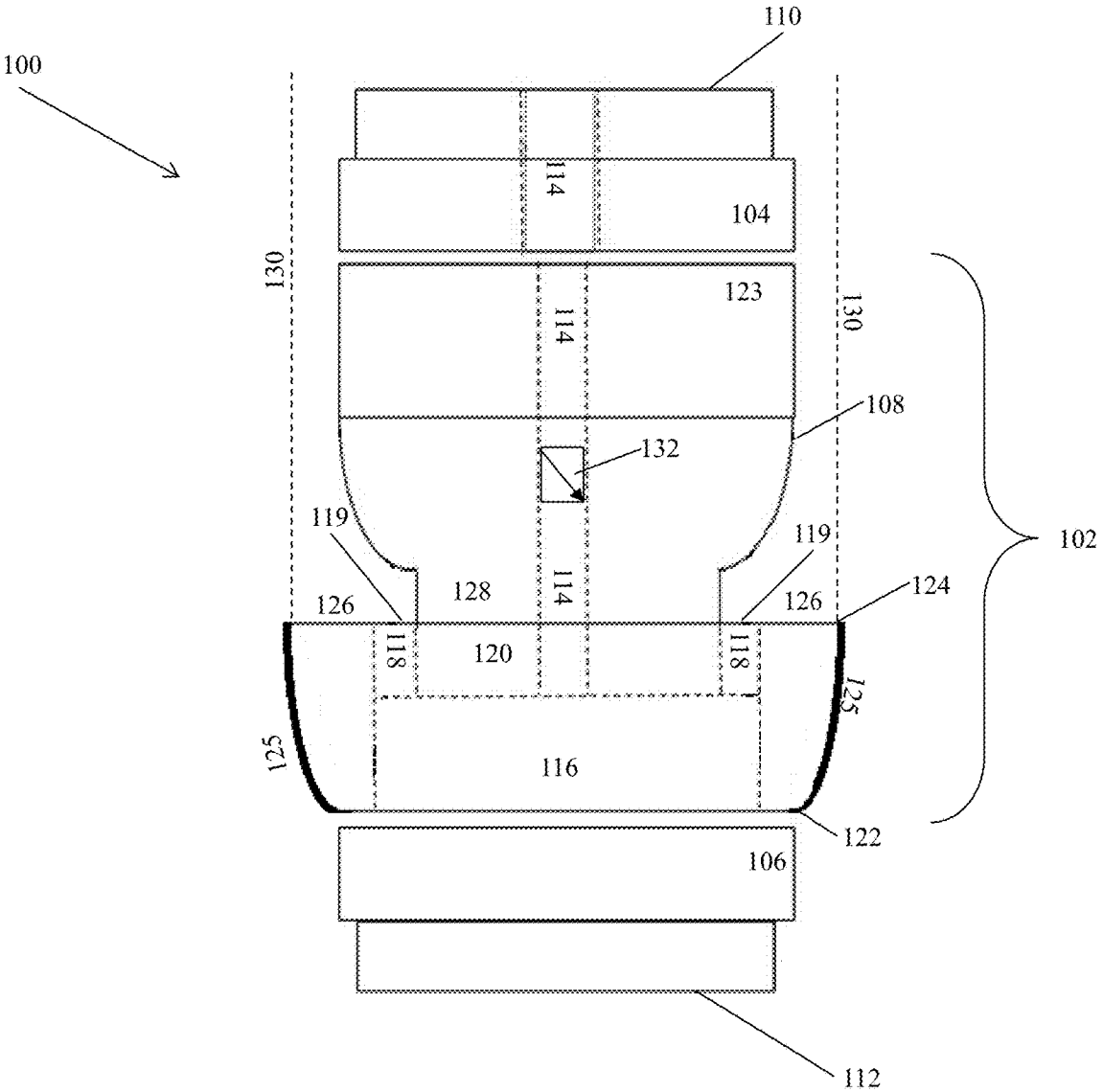
FIG. 1*b* is a cross-section view of a grouting module in accordance with the present disclosure.

FIGS. 1*a* and 1*b* illustrate embodiments of a grouting module 100, where like numerals represent like parts. The grouting module 100 may include a body 102, an upper adapter 104, and a lower adapter 106. The body 102 may be configured to compress and/or densify a substrate (not shown) around the grouting module 100 to form an annular space (not shown) around the pile shaft. The body 102 may also be configured to inject a viscous fluid (not shown), such as grout into the annular space. In some embodiments, the adapters 104, 106 may be configured to attach to other components (not shown) of a screw pile system (not shown). The adapters 104, 106 may be attached to the other components through any means known in the art, such as threaded or flanged connections.

An outer surface of the body 102 may include horizontal, vertical, slanted, and/or curved portions. The upper adapter 104 may include an upper surface 110 and the lower adapter 106 may include a lower surface 112. The upper surface 110 and the lower surface 112 may be horizontal. The grouting module 100 may be configured to be advanced downwards into a substrate, such that the lower surface 112 is facing downwards and the upper surface 110 is facing upwards.

The grouting module 100 may include an axial flowbore 114. The axial flowbore 114 may be aligned with a central axis (not shown) of the grouting module 100. The axial flowbore 114 may pass through the upper adapter 104, including the upper surface 110, and into the body 102. In some embodiments, the axial flowbore 114 does not pass through the lower adapter 112. The body 102 may include one or more radial flow chambers 116 proximate the lower adapter 112. The axial flowbore 114 may be fluidly connected to the flow chambers 116. The body 102 may also include one or more injection conduits 118. The injection conduits 118 may be fluidly connected to the flow chamber 116 and may pass through the outer surface 108 of the body 102, providing one or more outlets 119. In some embodiments, the axial flowbore 114 may be directly connected to the injection conduits 118.

The body 102 may be configured to compress a substrate (not shown) as the grouting module 100 is advanced into the substrate. The body 102 may include, for example, a flange 120. The flange 120 may have a smaller outer diameter at a lower end 122 and a larger outer diameter at an upper end 124. The lower end 122 may be proximate the lower adapter 106. In some embodiments, such as shown in FIG. 1*a*, the outer diameter of the flange 120 at the lower end 122 may be similar to the outer diameter of the upper adapter 104, the lower adapter 106, and a portion 123 of the body 102 proximate the upper adapter 104. The outer diameter of the flange 120 at the upper end 124 may be greater than the outer diameter of any other portion of the grouting module 100.

The flange 120 may include a tapered or sloped outer surface 125. The tapered or sloped outer surface may form a constant or varying angle to a central axis (not shown) of the grouting module 100. In some embodiments, such as illustrated in FIG. 1*a*, the angle of outer surface 125 may be constant, or may vary, such as illustrated in FIG. 1*b*.

The flange 120 may be configured such that when the grouting module 100 is rotated and advanced downward into a substrate, the flange 120 may compress the substrate outward, thereby compacting the substrate, and forming an annular space 130 around the outer surface 125 of grouting module 100. The flange 120 may compress the substrate by forcing it outward from the diameter at the lower end 122 to the diameter at the upper end 124.

The body 102 may include a lip 126. The lip 126 may be proximate the upper end 124 of the flange 120. In some embodiments, as shown in FIG. 1*a*, the lip 126 may be horizontal. In some embodiments, the lip 126 may be sloped or curved. The body 102 may include a neck 128 above and proximate to the lip 126. The neck 128 may be the same diameter as the outer surface 108, or have a reduced diameter compared to other portions of the grouting module 100, facilitating flow of grout from outlets 119 into annular space 130 as the pile is driven. In some embodiments, such as that shown in FIG. 1*a*, the neck 128 may be vertical. In some embodiments, the neck 128 may be sloped or curved. A portion of the body 102 above the neck 128 may have an outer diameter similar to that of the upper adapter 104 and the lower adapter 106. An outer surface of the body 102 may be slanted or curved outward from the neck 128 to the portion having an outer diameter similar to the adapters 104, 106.

The flow chamber 116 and the injection conduits 118 may be formed within the portion of the body surrounded by the flange 120, as shown in FIG. 1*a*. The flow chamber 116 may be proximate the lower adapter 106. The injection conduits 118 may extend upwards from the flow chamber 116 and may pass through the lip 126. In some embodiments, such as that shown in FIG. 1*a*, the injection conduits 118 may pass through the lip 126 via outlets 119 proximate the neck 128. In some embodiments, the injection conduits 118 may pass through the lip 126 at a distance from the neck 128. In some embodiments, the injection conduits 118 may pass through any portion of the outer surface of the body 102. The injection conduits may be vertical, as shown in FIG. 1*a*, or may be slanted, curved, or horizontal. The injection conduits 118 may be radially symmetric and equally spaced around a central axis of the body 102. The injection conduits 118 may have a diameter and configuration such that the grout may flow smoothly through the injection conduits 118 and a continuous stream of the grout may exit the injection conduits 118 while the pile is being advanced. The injection conduits 118 and the flange 120 may be formed of appropriate materials to provide the required strength during use and may be configured such that the flange 120 may apply sufficient compaction to the substrate to form the annular space without significant damage to the flange 120. Although grouting modules are left with the installed pile, not reused, a uniform annular space and complete fill of the annular space with grout is desired, and thus a flange 120 and module 100 of sufficient strength is preferred.

In some embodiments, the grouting module 100 may include a check valve 132, which may prevent backflow of grout or fluid from the injection conduits 118 and flow chamber 116 into the grouting module 100. The check valve may be disposed in the axial flowbore 114. The check valve may allow unidirectional flow into the grouting module 100 only through the axial flowbore 114 at the upper surface 110 of the grouting module 100. In some embodiments, the check valve may be disposed in a separate unit from the grouting module 100, such as in a lowermost upper pile connected to upper adapter 104. In some embodiments, the grouting module 100 may include more than one check valve, such that a check valve is disposed within each of the injection conduits 118. Such check valves may allow flow from the axial flowbore 114 into the injection conduits 118, but not allow flow from the injection conduits 118 into the axial flowbore 114. The check valves may be used, for example, to prevent backflow of grout from the annular space 130 when the screw pile advancement is temporarily stopped to attach another upper pile extension.

Figure 2A:
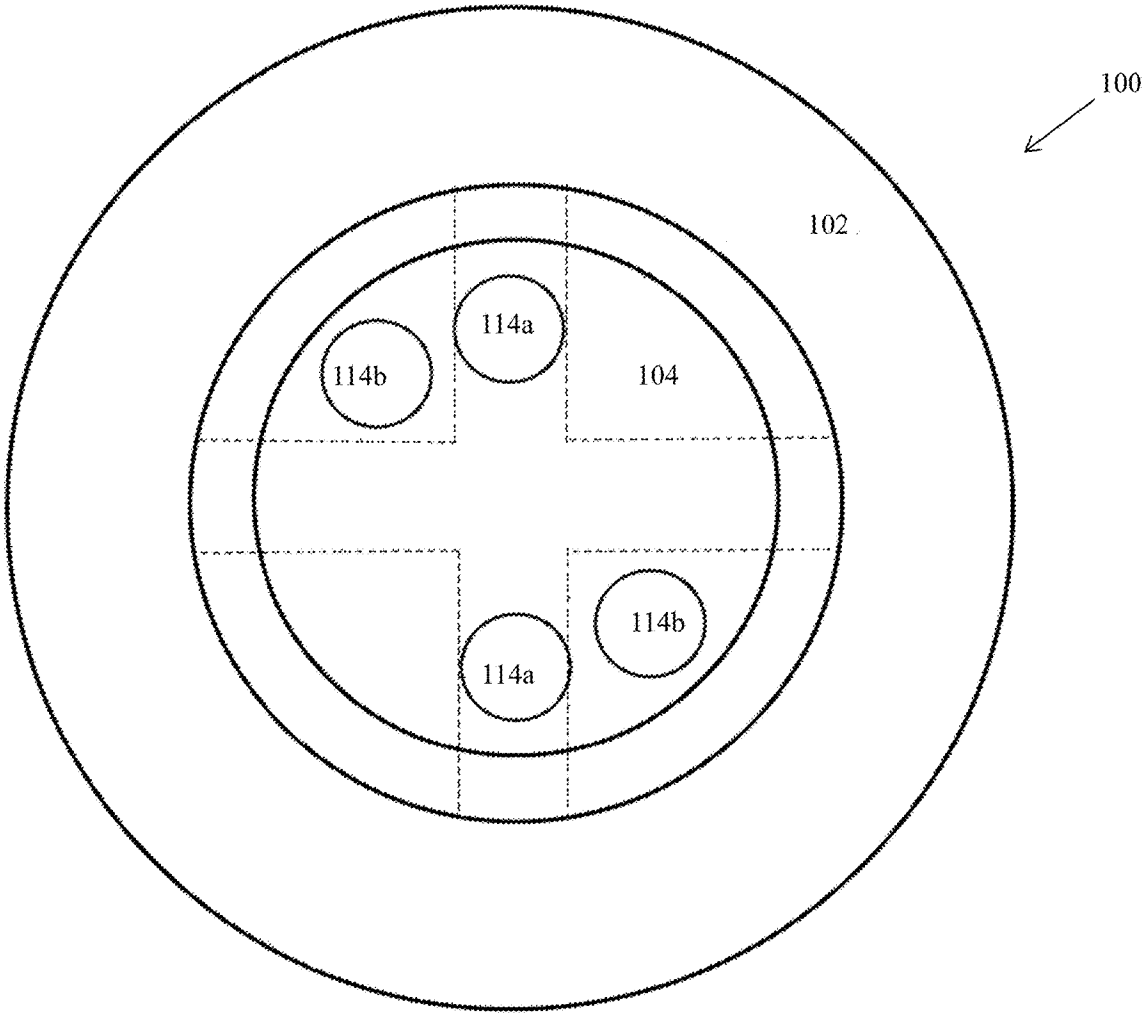
FIG. 2*a* is a top view of a grouting module in accordance with the present disclosure.
Figure 2B:
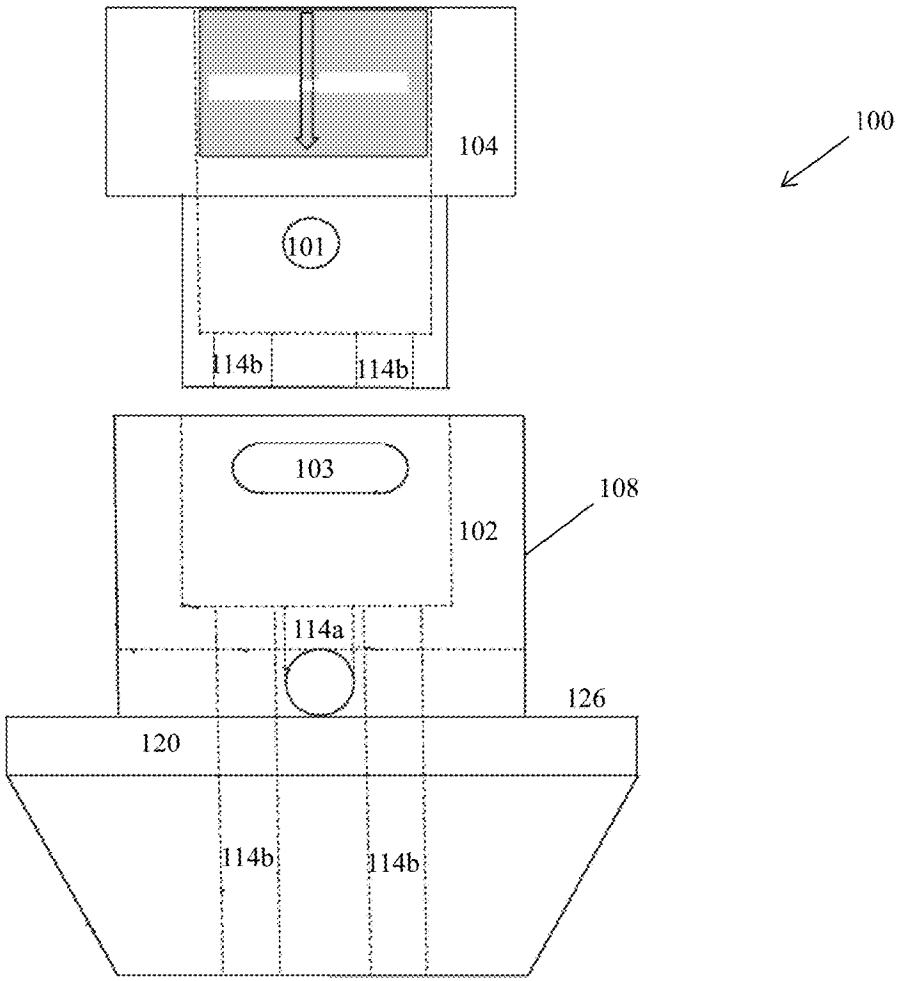
FIG. 2*b* is a side view of a grouting module in accordance with the present disclosure.
Figure 2C:
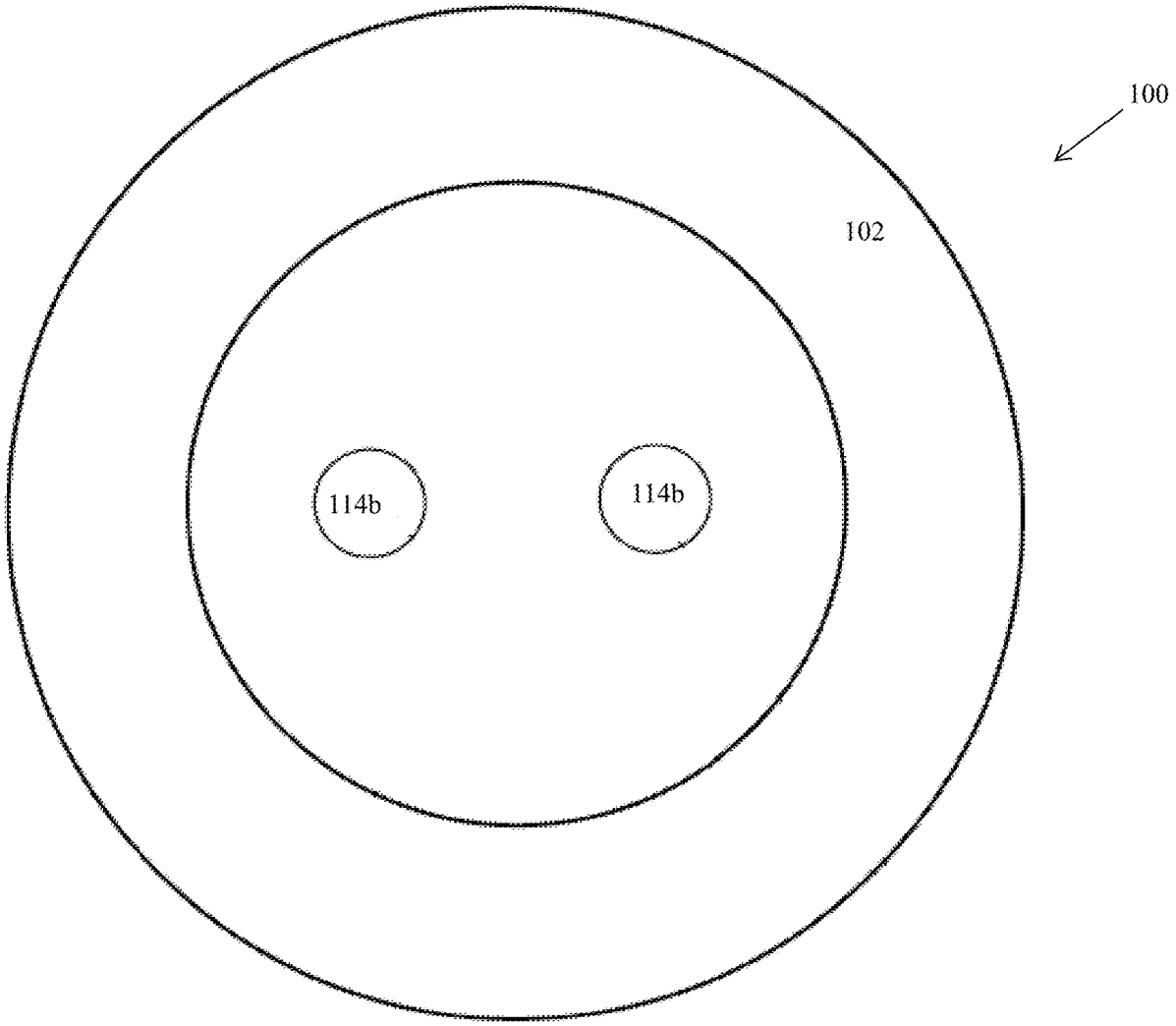
FIG. 2*c* is a bottom view of a grouting module in accordance with the present disclosure.

In some embodiments, it may also be desirable to flow grout through the grouting module to a lower portion of the system. A grouting module 100 may include flow conduits that may be selected for use based on a position of the body 102, as illustrated and described with respect to the grouting module shown in FIGS. 2*a*-2*c*. FIGS. 2*a*-2*c* illustrate a cross-section view, a side view, and a bottom view of a grouting module 100, respectively. The grouting module 100 may include features which are similar to those discussed above with respect to the grouting module 100 illustrated in FIGS. 1*a*-1*b*. Like features may be labeled with like numbers. Features which differ from the previously discussed embodiments will be discussed below. One skilled in the art will recognize a grouting module 100 may include any combination of features described with respect to FIGS. 1*a*-1*b* and FIGS. 2*a*-2*c*.

As shown in FIG. 2*b*, a grouting module 100 may include an upper adapter 104 and a body 102. The upper adapter 104 may be rotatably connected to the body 102, such that the upper adapter 104 may be rotated relative to the body. The upper adapter 104 may be configured to rotate between a first position and a second position relative to the body 102. The upper adapter 104 may be prevented from rotating beyond the first position and/or the second position, or the upper adapter 104 may be allowed to rotate to further positions relative to the body 102.

The upper adapter 104 may be connected to the body 102 via a threaded stud 101 disposed on the upper adapter 104 and a slot 103 formed on the body. FIG. 2*b* illustrates the upper adapter 104 and the body 102 in a disassembled configuration. In an assembled configuration, the threaded stud 101 may be disposed within the slot 103. When the upper adapter 104 is in a first position, as discussed above, the stud 101 may be at a first side of the slot 103, and when the upper adapter 104 is in a second position, the stud 101 may be at a second side of the slot 103. The grouting module 100 may or may not include elements for locking the upper adapter 104 in the first position and/or the second position.

The grouting module 100 may include one or more side discharge flowbores 114*a* and one or more bottom discharge flowbores 114*b*. In some embodiments, as shown in FIG. 2*a*, the grouting module 100 may include two side discharge flowbores 114*a* and two bottom discharge flowbores 114*b*.

In some embodiments, both the side discharge flowbores 114*a* and the bottom discharge flowbores 114*b* may extend through the upper adapter 104, such that the flowbores 114*a*, 114*b* extend from a top surface to a bottom surface of the upper adapter 104. In some embodiments, the upper adapter 104 may include nonspecific flowbores which are neither side discharge flowbores nor bottom discharge flowbores, but which are configured to be alternately aligned with both the side discharge flowbores 114*a* and the bottom discharge flowbores 114*b* which extend through the body 102.

The bottom discharge flowbores 114*b* may extend through the body 102, such that the flowbores extend from a top surface of the body 102, to a bottom surface of the body 102. The grouting module 100 may include a lower adapter (not shown), which may be fixedly attached to the body 102. In such embodiments, the bottom discharge flowbores 114*b* may extend through the lower adapter.

The side discharge flowbores 114*a* may extend through the body 102, such that the flowbores extend from a top surface of the body 102 and discharge at a point above a bottom surface of the body 102. In some embodiments, as shown in FIG. 2*b*, the side discharge flowbores 114*a* may discharge from an outer surface 108 of the body above the flange 120. In some embodiments, the side discharge flowbores 114*a* may be connected to injection conduits (not shown) which discharge from a lip 126 of the flange 120.

When the upper adapter 104 is in a first position relative to the body 102, the side-discharge flowbores 114*a* or the nonspecific flowbores of the upper adapter 104 may be aligned with the side discharge flowbores 114*a* of the body 102. In such a configuration, grout may be able to flow the side discharge flowbores 114*a* and may be discharged from the outer surface 108 of the body 102 and/or the lip 126 of the flange 120. In such a configuration, the bottom discharge flowbores 114*b* or nonspecific flowbores of the upper adapter 104 may not be aligned with the bottom discharge flowbores 114*b* of the body 102, such that grout may be prevented from flowing through the bottom discharge flowbores 114*b* of the body 102.

When the upper adapter 104 is in a second position relative to the body 102, the bottom discharge flowbores 114*b* or the nonspecific flowbores of the upper adapter 104 may be aligned with the bottom discharge flowbores 114*b* of the body 102. In such a configuration, grout may be able to flow the bottom discharge flowbores 114*b* and may be discharged from the lower surface of the body 102. The grout may flow from the lower surface into lower equipment (not shown). In such a configuration, the side discharge flowbores 114*a* or nonspecific flowbores of the upper adapter 104 may not be aligned with the side discharge flowbores 114*a* of the body 102, such that grout may be prevented from flowing through the side discharge flowbores 114*a* of the body 102.

In some embodiments, the grouting module 100 may include one or more alignment features (not shown). The alignment features may enable the upper adapter 104 to be selectively positioned relative to the body 102, such that the upper adapter 104 may be positioned in one or more desired orientations relative to the body 102. In some embodiments, the positioning may be based on the positions of the flowbores 114, 114*a*, 114*b* within the body 102 and the adapter 104. The alignment features may allow such positioning to be performed while the grouting module 100 is underground and may allow the positioning to be performed with a desired degree of precision. In some embodiments, the alignment features may further include locking mechanisms (not shown) which may allow the upper adapter 104 to be locked in position relative to the body 102. The alignment features may be any type of features known in the art.

In some embodiments, the grouting module may comprise two separate modules (not shown). A first module may compact the substrate and form an annular space around the screw pile. The second module may inject grout into the annular space. The second module may be located above the first module. The first module and the second module may have features described above which allow the grouting module to compress the substrate and to inject grout, respectively, while the pile is advanced.

The present disclosure may also relate to a grouting module including a check valve. The check valve may be disposed within an axial bore which may be formed at least partially through the grouting module and which may be configured to have grout flow therethrough. The check valve may allow flow of grout in a single direction and prevent flow of fluid in another direction. The check valve may be any type of check valve known in the art, and may be chosen/configured based on the dimensions of the grouting module, the viscosity of the grout flowed therethrough, and/or other considerations. However, a check valve is an optional component of the embodiment.

The grouting module may include some, all, or none of the features described above and may further include features not described above. In some embodiments, the grouting module may include a lower surface configured for connection to a screw pile component, an upper portion configured for connection to an upper hollow pile shaft, and one or more flow injection conduits for conveying grout received from the upper hollow pile shaft into an annular space formed above the grouting module as the pile is advanced downward into a substrate.

The check valve may allow fluid to flow into the grouting module at a top surface, through a bore of the grouting module, and out of the grouting module into a surrounding space. The check valve may prevent fluid from flowing into the grouting module from the surrounding space and out of the grouting module through the top surface. The check valve may ensure a unidirectional flow of fluid through the grouting module.

The grouting module may be configured for use in a screw pile system. During use, the grouting module may be advanced into a substrate. The check valve may ensure unidirectional flow of fluid through the grouting module while it is advanced into the substrate. The grouting module may receive fluid from a hollow pile shaft and may form an annular space in the substrate. The check valve may allow fluid to flow from the grouting module into the annular space and may prevent fluid from flowing from the annular space back into the grouting module and/or the hollow pile shaft.

In another aspect, the present disclosure relates to a screw pile system. The screw pile system may be used to install a pressure grouted screw pile in a substrate at a pile location. Components of the screw pile system may remain installed in the substrate at the pile location.

The screw pile system may include one or more hollow pile shaft extension, a grouting module, and an auger shaft. The grouting module may have features of the grouting module described above with respect to FIG. 1*a*. The one or more hollow pile shaft extension may be attached to each other by the use of a connector sleeve, and a most distal one of the hollow pile shaft extension may be attached to the grouting module. The grouting module may be connected to the auger shaft. The distal hollow pile shaft extension may be attached an upper adapter of the grouting module and the auger shaft may be attached to the lower adapter of the grouting module. The auger shaft may be alternately be referred to as an auger extension, an auger shaft extension, and/or a lead auger extension.

The screw pile system may further include a drive and a grout injection system. The drive may be configured to rotate the hollow pile shaft extension(s), the grouting module, and the auger shaft, thereby advancing the screw pile system into a substrate at a pile location, via flights on the auger shaft. The injection system may be configured to connect to and inject grout into the uppermost of the hollow pile shaft extension, such that the grout flows through the hollow pile shaft extensions, into the grouting module, and out of the grouting module outlets as the pile is being advanced.

Figure 3:
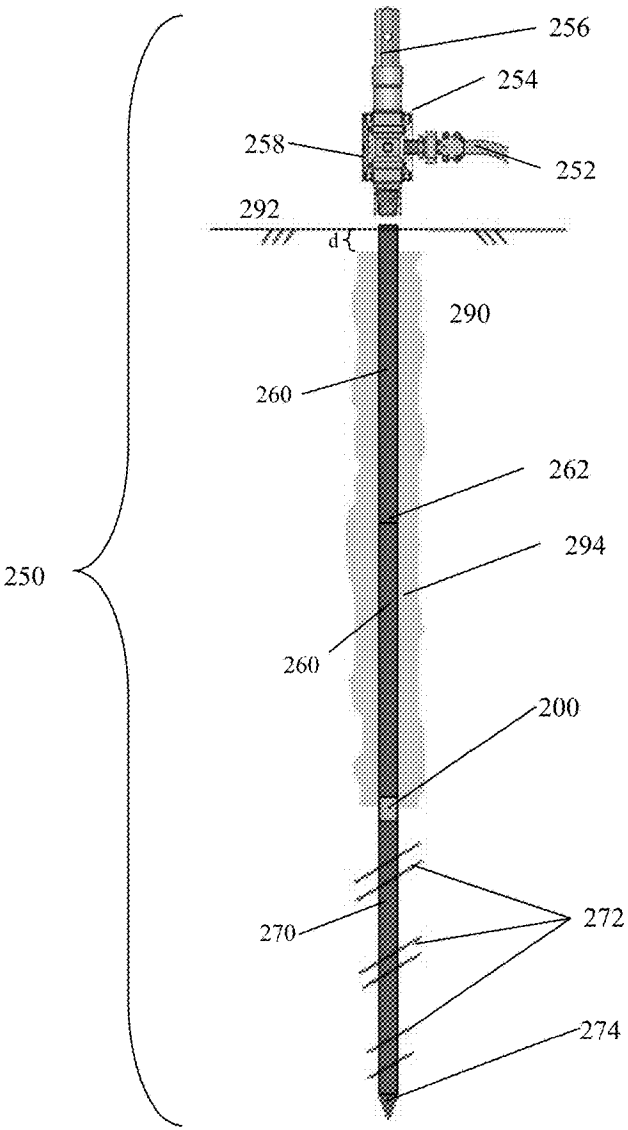
FIG. 3 is a schematic view of a pressure grouted screw pile system in accordance with the present disclosure.

FIG. 3 illustrates an embodiment of a screw pile system 250 in accordance with the present disclosure. The screw pile system 250 may include one or more hollow pile shaft extensions 260, a grouting swivel 254, and an auger shaft 270. The grouting module 200 may be connected between a distal end of the hollow pile shaft extensions 260 and a proximal end of the auger shaft 270.

The hollow pile shaft extensions 260 may be joined to each other at joints 262. The joints 262 may connect the hollow pile shaft extensions 260 by any means known in the art, and in some embodiments may be threaded connections. For example, in some embodiments, the joints 262 may comprise flanges which are screwed or bolted together, or other types of connectors.

In some embodiments, as shown in FIG. 3, the hollow pile shaft extensions 260 may be about the same length as each other. In some embodiments, the hollow pile shaft extensions 260 may have different lengths. The lengths of the hollow pile shaft extensions 260 may be chosen based on the equipment used to advance the hollow pile shaft extensions 260 into the substrate 290.

The hollow pile shaft extensions 260 may include a flowbore (not shown) formed therethrough. The flowbore may be aligned with a central axis of the hollow pile shaft extensions 260. The flowbore may be of sufficient diameter to allow grout to be pumped therethrough. The one or more hollow pile shaft extensions 260 may have flowbores of the same diameter. The flowbores may be aligned with each other to form a single flowbore passing through all of the hollow pile shaft extensions 260. The diameter of the flowbore may be chosen based on a flow rate of the grout, a physical property requirement of the pile, the advancement rate of the system, a diameter of the annular space being formed around the grouting module, the stiffness of the substrate 290, the viscosity of the grout, and/or other characteristics of the screw pile system 250, the grout, and/or the substrate 290.

The one or more hollow pile shaft extensions 260 may have the same outer diameter in some embodiments. The outer diameter of the hollow pile shaft extensions 260 may be chosen based on a drive rate of the system, a diameter of the annular space being formed around the grouting module, the stiffness of the substrate 290, the diameter of the flowbore, and/or other characteristics of the screw pile system 250, the grout, and/or the substrate 290.

The most distal of the hollow pile shaft extensions 260 may be attached to the grouting module 200. The hollow pile shaft extension 260 may be connected to the upper adapter (not shown) of the grouting module 200. The hollow pile shaft extension 260 and the upper adapter may be connected via any means known in the art.

As discussed above, the grouting module 200 may include an axial flowbore 114, as shown in FIG. 1*a*. The axial flowbore 114 may be co-axial with the flowbores of the hollow pile shaft extensions 260 and may have the same or different diameter as the flowbores of the hollow pile shaft extensions 260. As further discussed above, the grouting module 200 may include a check valve (not shown). In some embodiments, a check valve may be disposed in a hollow pile shaft extension 260 or in a component (not shown) disposed between the hollow pile shaft extensions 260 and the grouting module 200. The component may have a flowbore aligned with the axial flowbore 114 and the flowbores of the hollow pile shaft extensions 260.

The auger shaft 270 may be attached to the grouting module 200. The auger shaft 270 may be connected to the lower adapter (not shown) of the grouting module 200. The auger shaft 270 and the lower adapter may be connected via any means known in the art. The auger shaft may have any length and any diameter. In some embodiments, the length of the auger shaft may be between one and twenty feet, between five and fifteen feet, or about ten feet, for example. In some embodiments, the auger shaft 270 may include two or more connected shafts.

The auger shaft 270 may include one or more auger flights 272 attached to an outer surface of the auger shaft. The auger flights 272 may be configured to advance the auger shaft 270 into a substrate 290 when the auger shaft 270 is rotated. The auger flights 272 may have generally screw profiles or any profile known in the art. The auger flights 272 may have sloped or pointed edges along their outer diameters. The edges of the auger flights 272 may be configured to cut through the substrate 290.

The auger shaft 270 may include any number of auger flights 272. In some embodiments, the auger flights 272 may have different diameters, such that the flight diameters decrease, the further an auger flight 272 is located from the grouting module 200 (increasing diameters upward from tip 274). In some embodiments, the auger flights 272 may have about the same diameters. The diameters and pitch of the flights may be determined based on the drive rate of the system, the diameter of the auger shaft 270, the stiffness of the substrate 290, and/or other characteristics of the substrate 290 and/or system.

The auger flights 272 may be attached to the auger shaft 270 at an angle to a central axis (not shown) to the auger shaft 270. The pitch angle may be determined based on the drive rate of the system, the diameter of the auger shaft 270 (root diameter), the stiffness of the substrate 290, and/or other characteristics of the substrate 290 and/or system.

In some embodiments, as shown in FIG. 3, the hollow pile shaft extensions 260, the grouting module 200, and the auger shaft 270 may have similar outer diameters. As shown in FIG. 1*a*, the flange 120 of the grouting module 200 may have a larger outer diameter at an upper surface 122 than the hollow pile shaft extensions 260, the other portions of the grouting module 200, and the auger shaft 270. The auger flights 272 may also have a larger outer diameter than the hollow pile shaft extensions 260, the portions of the grouting module 200 other than the flange 120, and the auger shaft 270. The outermost diameter of the flange 120 of the grouting module 200 at the upper surface 122 may be larger than, smaller than, or similar to the outermost diameter of the auger flights 272. In some embodiments, the outermost diameter of the flange 120 at the upper surface 122 may be the same as or greater than the outer diameter of the auger flights 272.

The screw pile system 250 may include an injection system for injecting grout into an uppermost hollow pile shaft extension 260. The injection system may include a grout storage tank or vessel (not shown), a pump (not shown), and a grouting swivel 254. The required pressure capacity of the injection system may depend upon various factors, such as the viscosity of the grout, the pressure drop at total depth of pile (which may be a function of the diameter of bore 114, conduits 118, among other factors), the desired fill rate of grout into annular space 130, and must also be sufficient to overcome the back pressure resulting from the column of grout formed above outlets 119 as the pile is being driven. The pump may be connected to the uppermost hollow pile shaft extension 260 via a flowline 252 and a grouting swivel 254. The grouting swivel 254 may allow the hollow pile extensions 260 to rotate independently from the flowline connector 252 as the pile is advanced into the substrate.

The screw pile system 250 may include a drive system to advance the auger shaft 270, the grouting module 200, and the hollow pile shaft extensions 260 into the substrate 290. The drive system may be an auger drive motor (not shown). The drive system may be connected to the grouting swivel 254 via a drive head 256, as shown in FIG. 3. In some embodiments, the drive system may be connected to the hollow pile shaft extensions 260 through any means known in the art, either directly, or indirectly, such that the drive system is connected to the hollow pile shaft extensions 260 via the grouting swivel 254 and drive connector 258. The drive system may be supported by a conventional skid-steer or excavator and may be connected to the boom of the skid-steer, excavator, or other suitable equipment.

The screw pile system 250 may include sensors (not shown) which may be disposed on components of the system 250 or in the environment surrounding the system 250, including in the substrate 290 and which may measure one or more system parameters. In some embodiments, the sensors may measure flow rate of the grout, torque and drive rate of the auger motor, temperature of the grout or components of the system 250, pressure experienced by the grout or by system components, viscosity of the grout, or other parameters. The measurements may be made in real time in some embodiments. The system 250 may also include a control system for controlling a drive rate of the auger shaft 270, the grouting module 200, and the hollow pile shaft extensions 260, as well as a flow rate of a fluid into the hollow pile shaft extensions 260. The control means (not shown) may receive information from the sensors and may adjust operating parameters of the system 250 accordingly. The control means may include a network, which may or may not be wireless. The control means may or may not require input from a human operator. Information from the control system and the sensors may be displayed to a human user.

After installation, the drive means, the drive head 256, the injection means, the flowline 252, the grouting swivel 254, and the control means may be removed. In some embodiments, some or all of the sensors may be removed after installation. The hollow pile shaft extensions 260, the grouting module 200, and the auger shaft 270 may remain installed at the pile site. The hollow pile shaft extensions 260, the grouting module 200, and the auger shaft 270, in combination with grout injected around the system 250, may form a pressure grouted screw pile.

Figure 4:
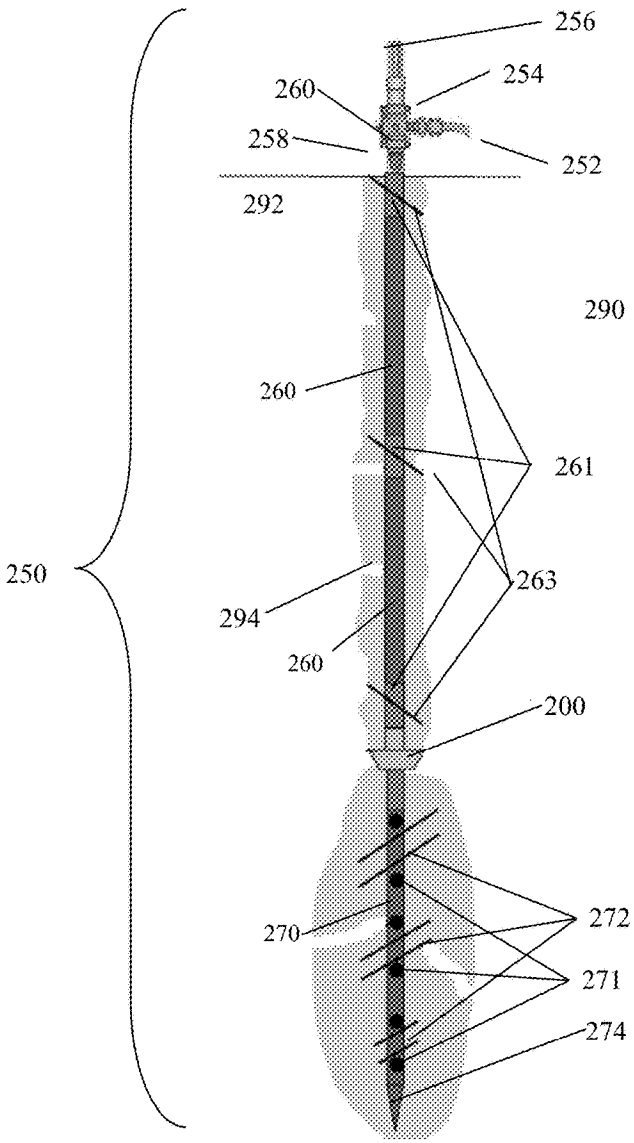
FIG. 4 is a schematic view of a pressure grouted screw pile system in accordance with the present disclosure.

FIG. 4 illustrates another embodiment of a screw pile system 250 in accordance with the present disclosure. The screw pile system 250 may include features which are similar to those discussed above with respect to the screw pile system 250 illustrated in FIG. 3. Like features may be labeled with like numbers. Features which differ from the previously discussed embodiments will be discussed below. One skilled in the art will recognize a screw pile system 250 may include any combination of features described with respect to FIG. 3 and FIG. 4.

FIG. 4 illustrates a screw pile system 250 including a grouting module 200 which may be configured to discharge grout both at the side and at the bottom, as described above with respect to FIGS. 2*a*-2*c*. The grouting module 200 may have the same features as the grouting module 100 described with respect to FIGS. 2*a*-2*c* or may have different features.

The screw pile system 250 may include an auger shaft 270 having a tip 274 and auger flights 272. The auger flights 272 may have features similar to those described above with respect to FIG. 3. The auger shaft 270 may further include an axial passageway (not shown) and one or more grouting ports 271. The axial passageway may extend through the length of the auger shaft 270 and may be aligned with bottom discharge flowbores (114*b* in FIGS. 2*a*-2*c*) of the grouting module 200. In this way, grout may be able to flow from the grouting module 200 into the axial passageway of the auger shaft 270 when the grouting module 200 is configured to allow flow into the bottom discharge flowbores. The grouting ports 271 may extend from the axial passageway to an outer surface of the auger shaft 270. The grouting ports 271 may allow grout to be discharged from the side of the auger shaft 270. In some embodiments, a grouting port may be formed at a distal end of the tip 274. The number, spacing, and size of the grouting ports may be determined based on properties of the grout, the substrate 290, and the screw pile system 250.

The screw pile system 250 may include pile extensions 260. The pile extensions 260 may be joined to each other directly or via pile couplings 261. The pile couplings 261 may include grout seals such that grout may not be permitted to exit the screw pile system 250 through the joints between the pile couplings 261 and the pile extensions 260. The pile couplings 261 may include reverse auger flights 263 disposed on an outer surface. The reverse auger flights 263 may be angled in a direction opposite to the auger flights 272 of the auger shaft 270. A diameter and angle of the reverse auger flights 263 may be determined by properties of the substrate 290 and the screw pile system 250. In some embodiments, a diameter of the reverse auger flights 263 may be less than a diameter of the auger flights 272.

The reverse auger flights 263 may maintain downward pressure on grout injected around the pile extensions 260 as the screw pile system 260 is installed to prevent grout injected from the grouting module 200 from traveling upward around the pile shafts 260 and reaching the surface of the substrate 290.

Figure 5A:
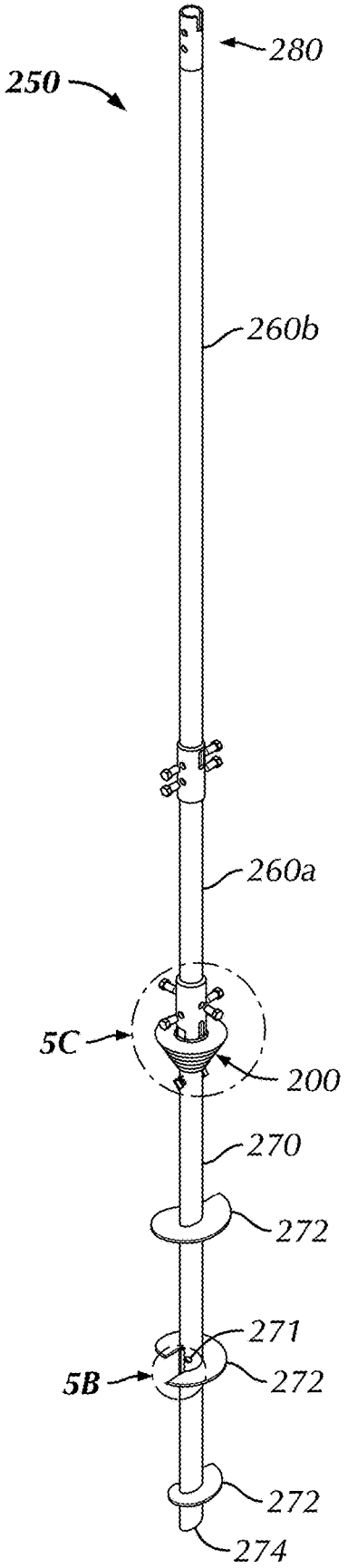
FIG. 5*a* is a side view of a pressure grouted screw pile system in accordance with the present disclosure.

FIG. 5*a* illustrates another embodiment of a screw pile system 250 in accordance with the present disclosure. The screw pile system 250 may include features which are similar to those discussed above with respect to the screw pile system 250 illustrated in FIGS. 3 and 4. Like features may be labeled with like numbers. Features which differ from the previously discussed embodiments will be discussed below. One skilled in the art will recognize a screw pile system 250 may include any combination of features described with respect to FIG. 3 and FIG. 4 or may have different features.

Figure 5B:
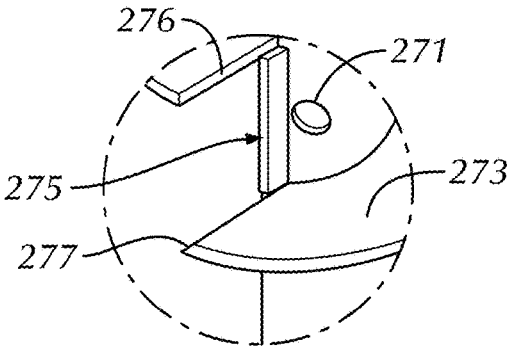
FIGS. 5*b* and 5*c* are close-up views of the pressure grouted screw pile system of FIG. 5*a* in accordance with the present disclosure.

The screw pile system 250 may include an auger shaft 270 having a tip 274 and auger flights 272. The auger flights 272 may have features similar to those described above with respect to FIGS. 3 and 4. While it is noted that three auger flights 272 are shown in FIG. 5*a*, one skilled in the art will appreciate how this is only for example purposes and there may be any number of auger flights 272 without departing from the scope of the present disclosure. The auger shaft 270 may further include an axial passageway (not shown) and one or more grouting ports 271, as shown in FIG. 5*b*. FIG. 5*b*, in or more embodiments, illustrates a blown up view of circle 5*b* of FIG. 5*a* on the auger shaft 270. The grouting ports 271 may be provided within helix blades 273 of the auger flights 272. It is further envisioned that a paddle 275 may be disposed between a top end 276 of the helix blade 273 and a bottom end 277 of the helix blade 273.

Figure 5C:
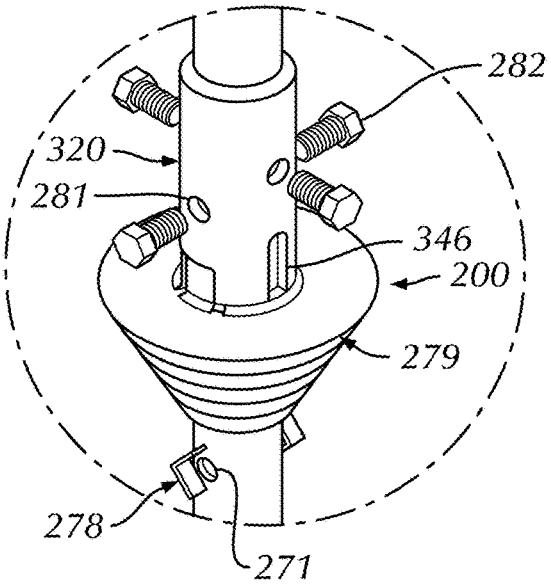

Still referring to FIG. 5*a*, the axial passageway may extend through the length of the auger shaft 270 and may be aligned with bottom discharge flowbores of a grouting module 200 as shown in FIG. 5*c*. FIG. 5*c*, in or more embodiments, illustrates a blown up view of circle 5*c* of FIG. 5*a* on the grouting module 200 of the screw pile system 250. In a non-limiting example, the grouting module 200 which may be configured to discharge grout both at the side and at the bottom through the grouting ports 271. Additionally, the grouting ports 271 may have an angled paddle 278 surrounding all or a portion of the grouting ports 271.

Further, the grouting module 200 may have a cone 279 with a grout coupler 320 disposed above the cone 279 to couple to pile extension (260*a*). Additionally, the grout coupler 320 may include a slot 346 to act as a grouting port (271) above the cone 279. In this way, grout may be able to flow from the grouting module 200 into the axial passageway of the auger shaft 270 when the grouting module 200 is configured to allow flow into the bottom discharge flowbores and/or out of slot 346 above the grouting module, either concurrently or sequentially. The grouting ports 271 may extend from the axial passageway to an outer surface of the auger shaft 270. The grouting ports 271 may allow grout to be discharged from the side of the auger shaft 270. In some embodiments, a grouting port may be formed at a distal end of the tip 274. The number, spacing, and size of the grouting ports may be determined based on properties of the grout, the surrounding substrate, and the screw pile system 250.

The screw pile system 250 may include pile extensions (260*a*, 260*b*). The pile extensions (260*a*, 260*b*) may be joined to each other directly or via pile couplings 261. In a non-limiting example, a bottom pile extension 260*a* may be connected to between the grouting module 200 and a top pile extension 260*b*. Additionally, the bottom pile extension 260*a* may be shorter in length than the top pile extension 260*b*. For example purposes only, an end 280 is shown without a pile coupling. The pile couplings 261 may include grout seals such that grout may not be permitted to exit the screw pile system 250 through the joints between the pile couplings 261 and the pile extensions (260*a*, 260*b*). The pile couplings 261 may include a plurality of holes 281 for bolts or screws 282 to be inserted into and go through to holes 283 of the pile extensions (260*a*, 260*b*). One skilled in the art will appreciate how the pile extensions (260*a*, 260*b*) and pile couplings 261 described herein are shown for non-limiting example purposes only and may be any system or configuration known in the art without departing from the scope of the present disclosure.

Figure 6A:
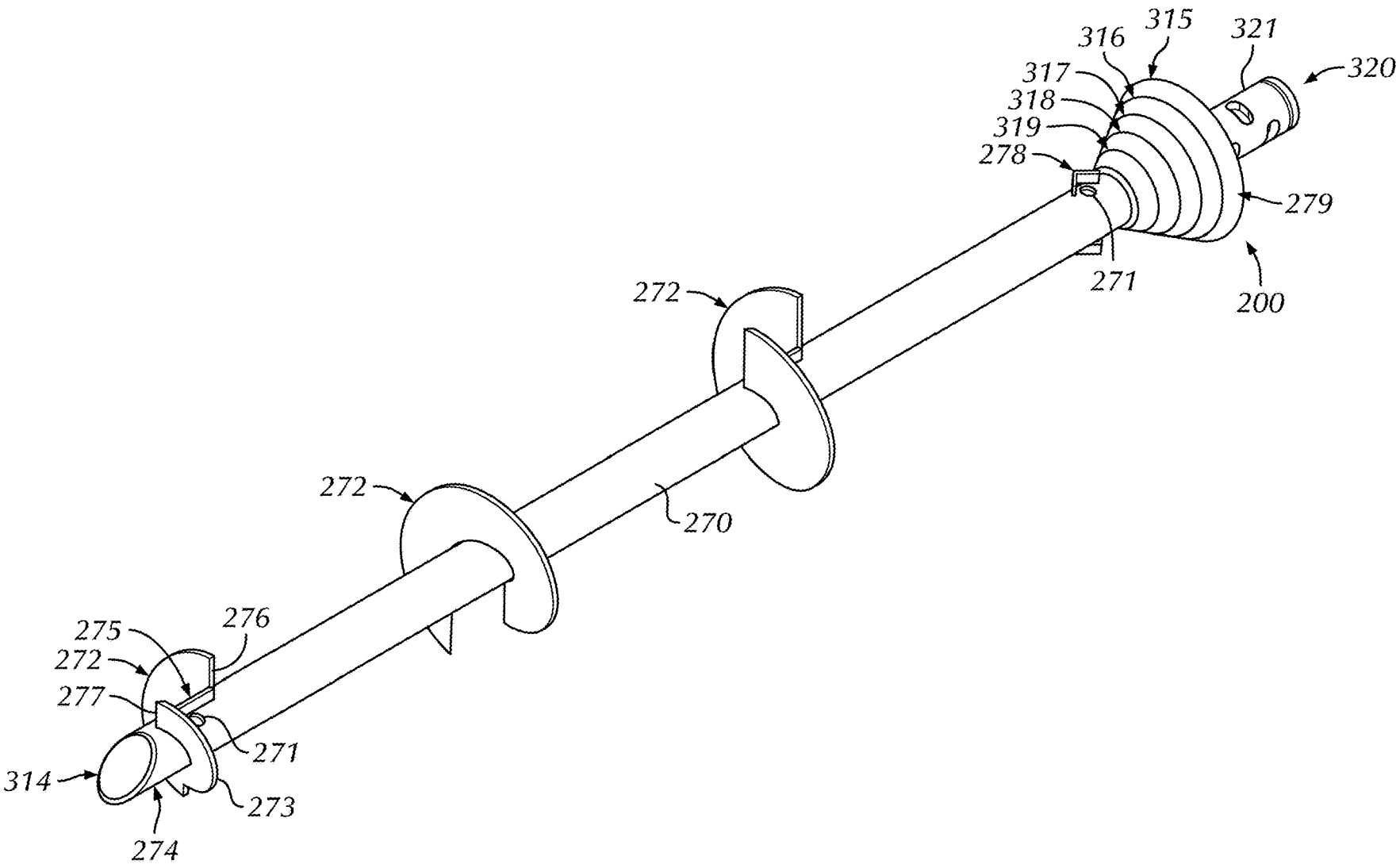
FIGS. 6*a*-6*d* are views of an auger shaft and a grouting module of the pressure grouted screw pile system of FIG. 5*a* in accordance with the present disclosure.

With reference to FIG. 6*a*, in one or more embodiments, FIG. 6*a* illustrates a perspective view of the auger shaft 270 and the grouting module 200 in accordance with the present disclosure. The grouting module 200 may be integrated with the auger shaft 270 to form a single auger grouting module (270, 200). The auger shaft 270 may have the tip 274 closed by a grout cap 314. While it is noted that three auger flights 272 are shown in FIG. 6*a*, one skilled in the art will appreciate how this is only for example purposes and there may be any number of auger flights 272 without departing from the scope of the present disclosure. The auger shaft 270 may further include the axial passageway (300) and the one or more grouting ports 271. It is further envisioned that the paddle 275 may be disposed between a top end 276 of the helix blade 273 and a bottom end 277 of the helix blade 273. Additionally, the grouting ports 271 may have the angled paddle 278 surrounding all or a portion of the grouting ports 271.

Figure 6B:
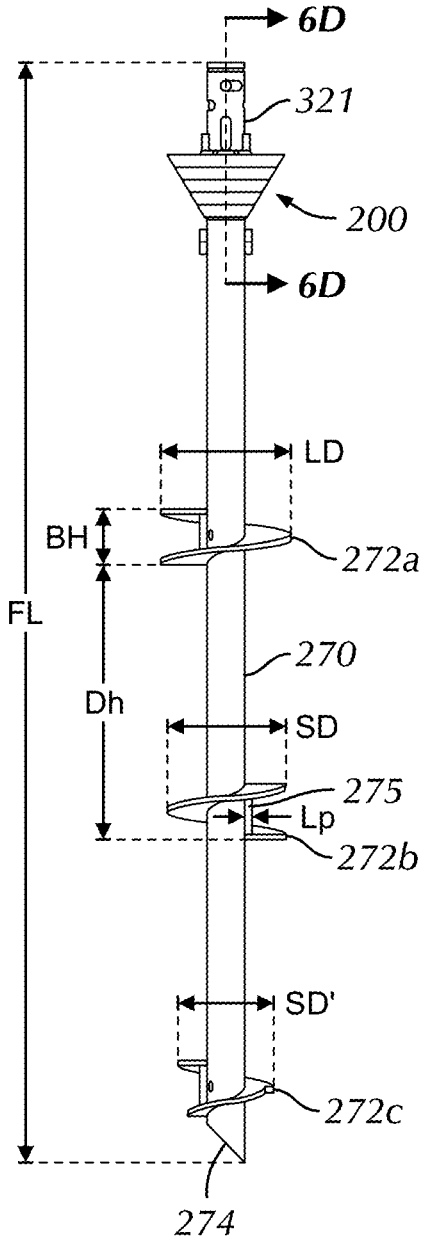
Figure 6C:
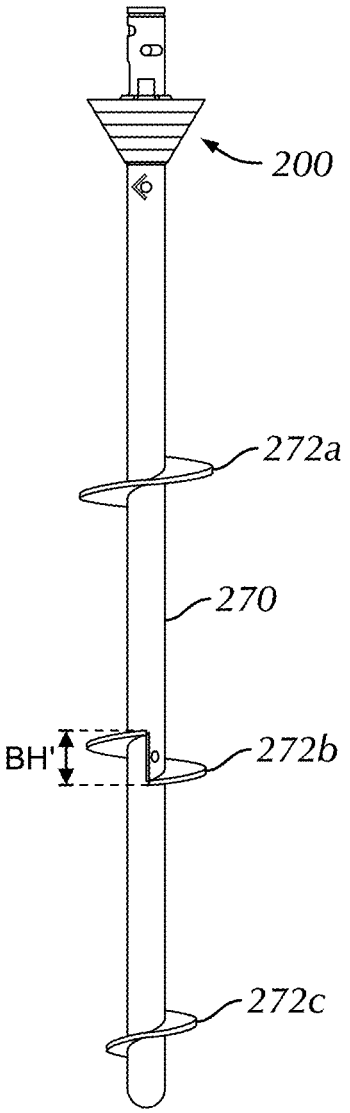

Still referring to FIG. 6*a*, the grouting module 200 may include the cone 279. In a non-limiting example, the cone may have a first section 315, a second section 316, a third section 317, a fourth section 318, and a fifth section 319 stacked on top of each other. It is further envisioned that all the sections (315-319) of the cone 279 may have a bevel angle to create a cone shape where the first section 315 has a largest diameter with the followings sections progressively getting smaller to have the fifth section 319 has a smallest diameter. In a non-limiting example, the bevel angle may be 30 degrees for all the sections (315-319). Additionally, above the cone 279, a lower section 321 of a grout coupler 320 may be coupled. In FIG. 6*b*, the single auger grouting module (270, 200) is shown from a side view having a full-length FL from the tip 274 to a top of the lower section 321 of the grout coupler 320. FIG. 6*c* illustrates a side view of the single auger grouting module (270, 200) 90 degrees from the side view of 6*b*. Further, the single auger grouting module (270, 200) may have a top auger flight 272*a*, a middle auger flight 272*b*, and a bottom auger flight 272*c*. A distance Dh may be provided between the top auger flight 272*a* and the middle auger flight 272*b*. It is further envisioned that the top auger flight 272*a* may have helix blade with a largest diameter LD, the middle auger flight 272*b* may have helix blade with a smaller diameter SD, and the bottom auger flight 272*c* may have helix blade with a smallest diameter SD'. Additionally, the helix blade of the top auger flight 272*a* may have a blade height BH bigger than a blade height BH' of the helix blade of the middle auger flights 272*b*. Furthermore, the paddle 275 may extend a length Lp out from the shaft of the single auger grouting module (270, 200).

Figure 6D:
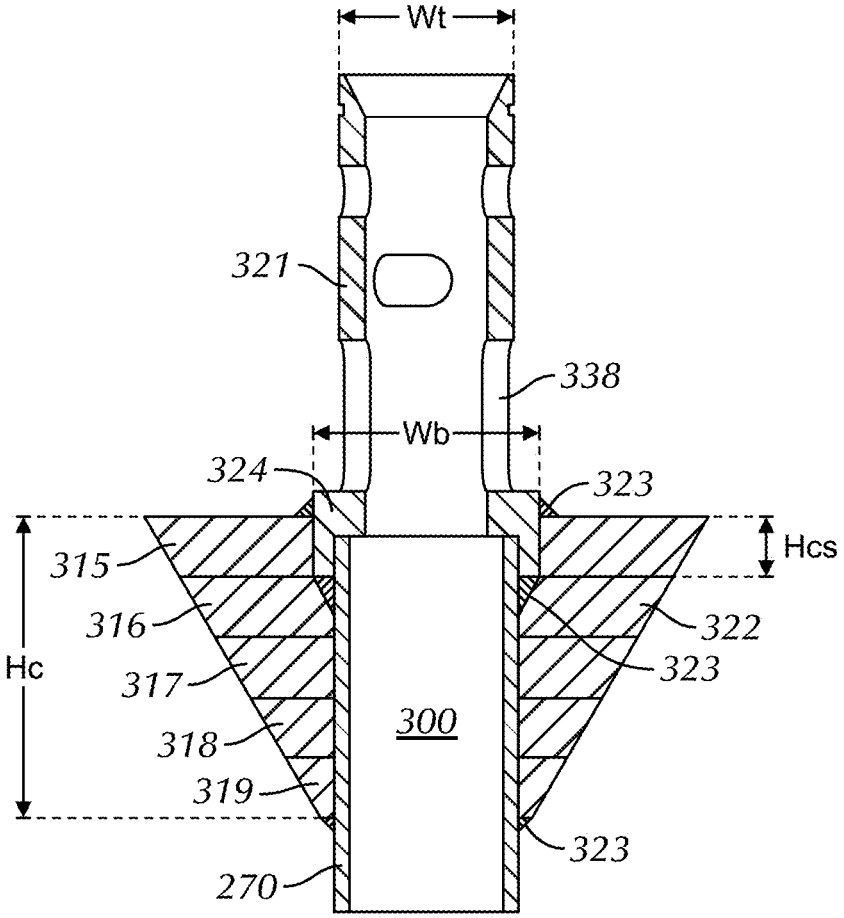

Referring to FIG. 6*d*, a cross-sectional view of the grouting module 200 along line 6*d*-6*d* in FIG. 6*b* is illustrated. The cone 279 may have a height Hc from the first section 315 to the fifth section 319. Additionally, the second section 316, the third section 317, and the fourth section 318 are in between the first section 315 to the fifth section 319. Further, each section (315-319) may have a height Hcs that is each one fifth of the height Hc of the cone 279. While the height Hc of each section (315-319) is shown to be the same for each section (315-319), it is further envisioned that the height Hc of each section may not be equal or any height without departing from the scope of the present disclosure. In some embodiments, each section (315-319) is adjacent to each other and has no gaps to create one continuous cone (279) with a flush slanted outer surface 322. While it is noted that the outer surface of the cone 279 is shown as having a slanted profile, the outer surface of the cone 279 may have a stepped, helix, or any profile without departing from the scope of the present disclosure. Further, the grouting module 200 may have multiple bevels 323 through the cone 279. Additionally, the lower section 321 of the grout coupler may have a base 324 coupled to the cone 279 having a base width Wb larger than a width Wt of a top end of the lower section 321.

Still referring to FIG. 6*d*, in one or more embodiments, the lower section 321 may have a slot, hole, or elliptical passage 338. The passage 338 may act as a grouting port (271). In a non-limiting example, the passage 338 may have a shape of an ellipse or any circular shape. In this way, grout may be able to flow out of the passage 338 above the cone 279 such that some of the grout does not flow into the axial passageway 300 of the auger shaft 270. Additionally, excess grout in the axial passageway 300 may flow upward to allow grout to be discharged from the slot 338 on sides of the lower section 321. The number, spacing, and size of the slot 338 may be determined based on properties of the grout, the surrounding substrate, and the screw pile system 250.

Figure 7A:
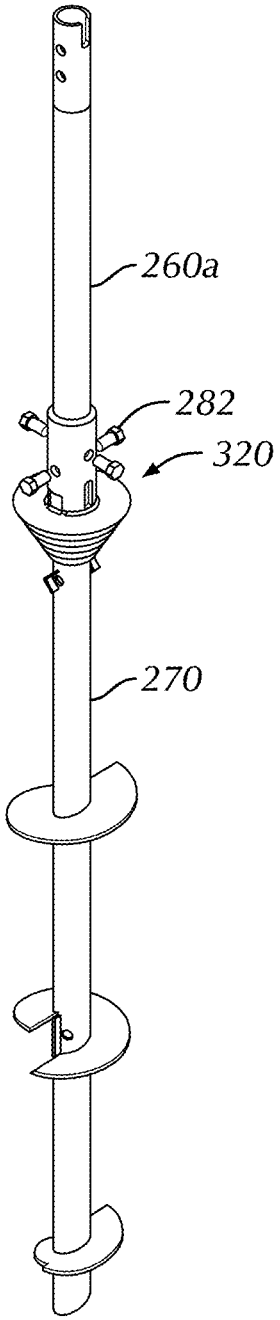
FIGS. 7*a*-7*d* are views of auger shaft and a grouting module coupled to a pile extension of the pressure grouted screw pile system of FIG. 5*a* in accordance with the present disclosure.
Figure 7B:
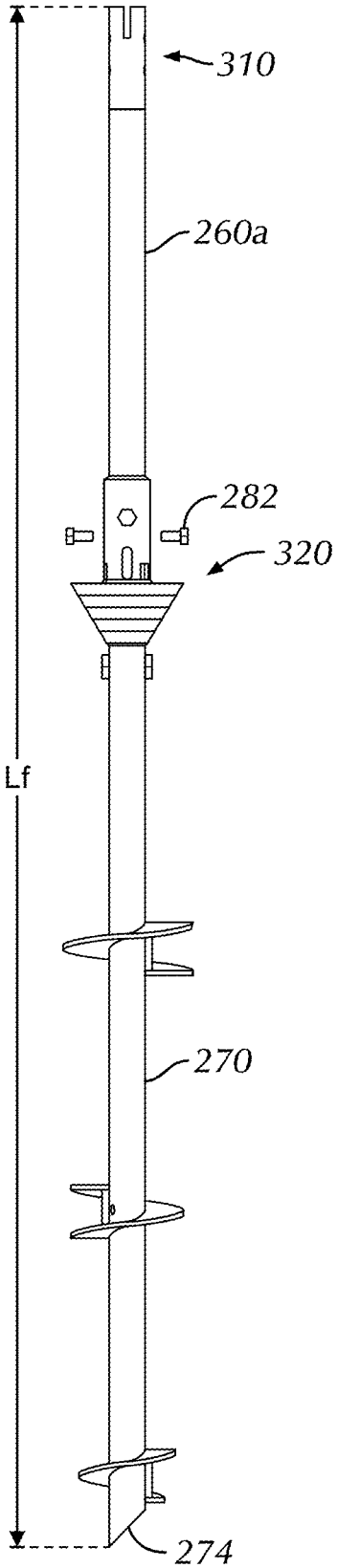

In one or more embodiments, FIG. 7*a* illustrates a perspective view of the single auger grouting module (270, 200) coupled to the bottom pile extension 260*a* via the grout coupler 320 to create a single extended screw pile (270, 200, 260*a*). The bolts or screws 282 may used to lock the single auger grouting module (270, 200) to the bottom pile extension 260*a* through the grout coupler 320. In FIG. 7*b*, the single extended screw pile (270, 200, 260*a*) is illustrated from a side view having a length Lf from the tip of the auger shaft 270 to the first end 310 of the bottom pile extension

Figure 7C:
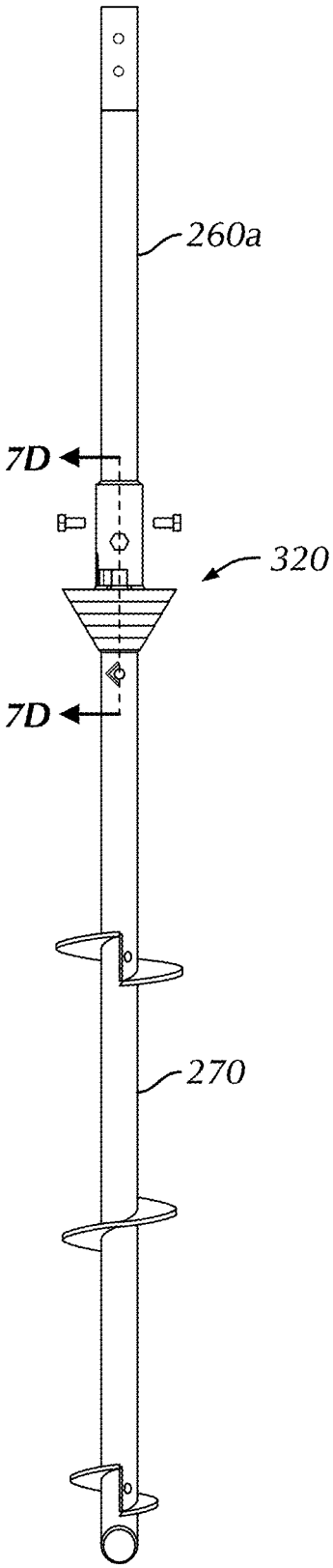
Figure 7D:
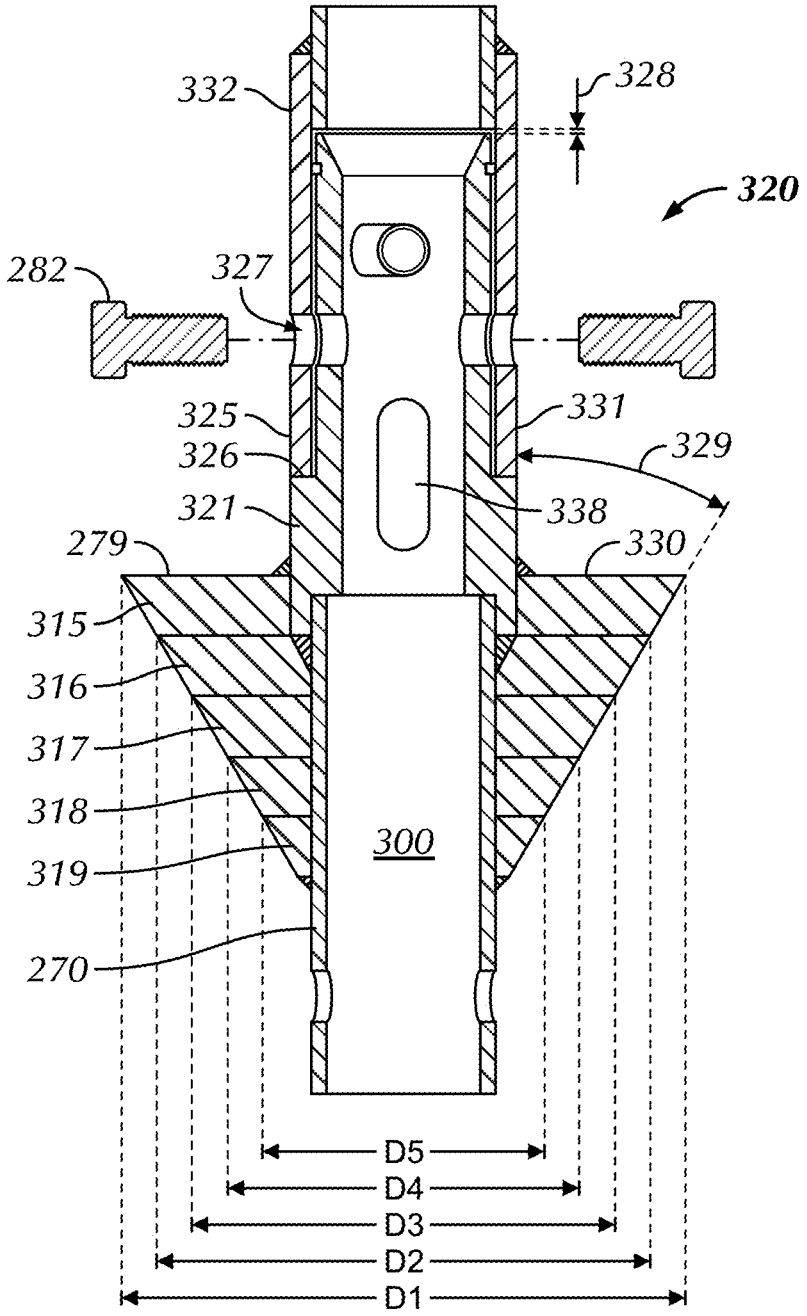

260*a*. In FIG. 7*c*, the single extended screw pile (270, 200, 260*a*) is shown from a side view rotated 90 degrees from the side view of FIG. 7*b*. In FIG. 7*d*, in one or more embodiments, a cross-sectional view taken along line 7*d*-7*d* on the cone 279 and the grout coupler 320 in FIG. 7*c* is illustrated. In some embodiments, the grout coupler 320 may include the lower section 321 and an upper section 332. A shoulder 325 of the upper section 332 abuts against a load shoulder 326 of the lower section 321 such that the upper section 332 surrounds the lower section 321. With the upper section 332 on the lower section 321, the bolts or screws 282 are inserted into through holes 327 of the upper section 332 and the lower section 321 to form the grout coupler 320. It is further envisioned that a gap 328 may be provided at a top of the lower section 321. Additionally, an angle 329 may be formed from a top surface 330 of the cone 279 to an outer surface 331 of the grout coupler 320. In a non-limiting example, the angle 329 may be 30 degrees to match the bevel angles of the sections (315-319) of the cone 279.

As described above, the cone 279 may have the first section 315 with the largest diameter with the followings sections (316-319) progressively getting smaller to the fifth section 319 having the smallest diameter. In one or more embodiments, FIG. 7*d* illustrates said change in diameter of the sections (315-319). In a non-limiting example, the first section 315 may transition from a first diameter D1, which is the largest diameter of the cone 279, to a second diameter D2 smaller than the first diameter D1. Additionally, the second section 316 may transition from the second diameter D2 to a third diameter D3 smaller than the second diameter D2. Further, the third section 317 may transition from the third diameter D3 to a fourth diameter D4 smaller than the third diameter D3. Furthermore, the fourth section 318 may transition from the fourth diameter D4 to a fifth diameter D5 smaller than the fourth diameter D4. Lastly, the fifth section 319 may transition from the fifth diameter D5 to a final diameter, which is the smallest diameter of the cone 279.

Figure 8A:
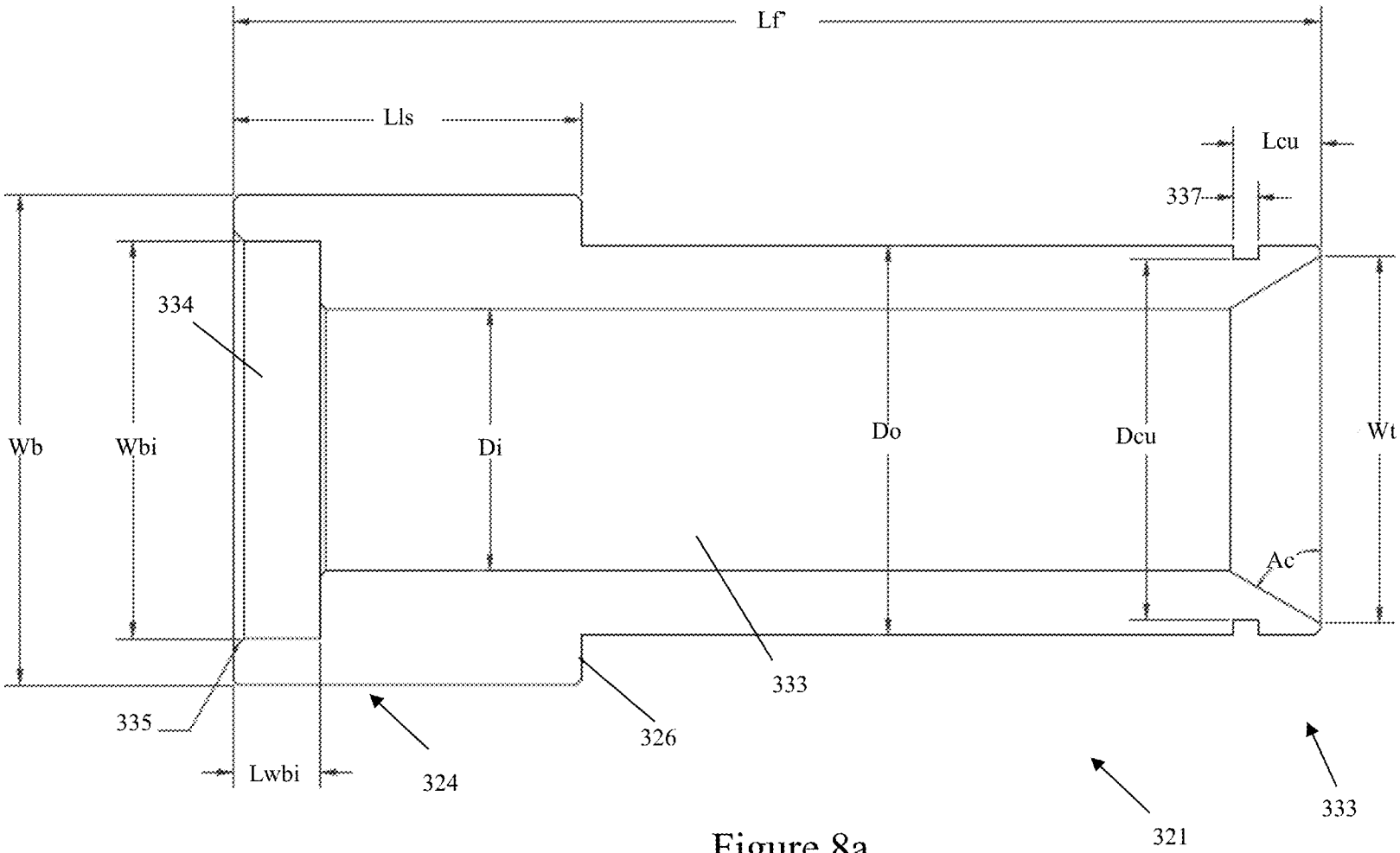
FIGS. 8*a*-8*d* are views of a lower section of a grout coupler of the pressure grouted screw pile system of FIG. 5*a* in accordance with the present disclosure.

Referring to FIGS. 8*a*-8*d*, in one or more embodiments, the lower section 321 of the grout coupler (320) is illustrated. In FIG. 8*a*, a schematic view of the lower section 321 is illustrated. In a non-limiting example, the lower section 321 extends a length Lf from the base 324 to a top end 333. Additionally, from the base 324, the load shoulder 326 of the lower section 321 extends a length Lls smaller than the length Lf. Further, the base 324 has the outer width Wb and an inner width Wbi. The inner width Wbi may extend a length Lwbi to form a chamber 334 within the base 324 and the chamber may have a beveled end 335. Furthermore, the lower section 321 may have an inner bore 336 extending from the chamber 334 to a cut-out 337. The inner bore 336 has an inner diameter Di and an outer diameter Do extending from the load shoulder 326 such that the top end 333 has the width Wt. It is further envisioned that the lower section 321 has two cut-outs 337 spread a diameter Dcu to reduce an outer diameter at the cut-outs 337 at a distance Lcu from the top end 333. In some embodiments, the top end 333 may be chamfered at an angle Ac.

Figure 8C:
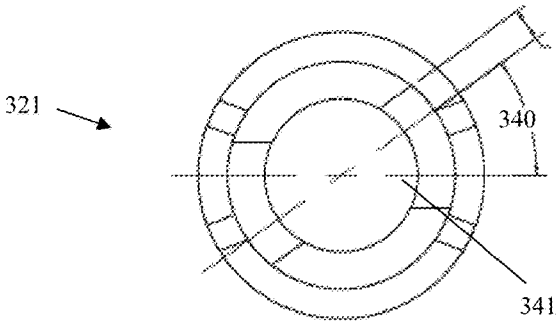
Figure 8D:
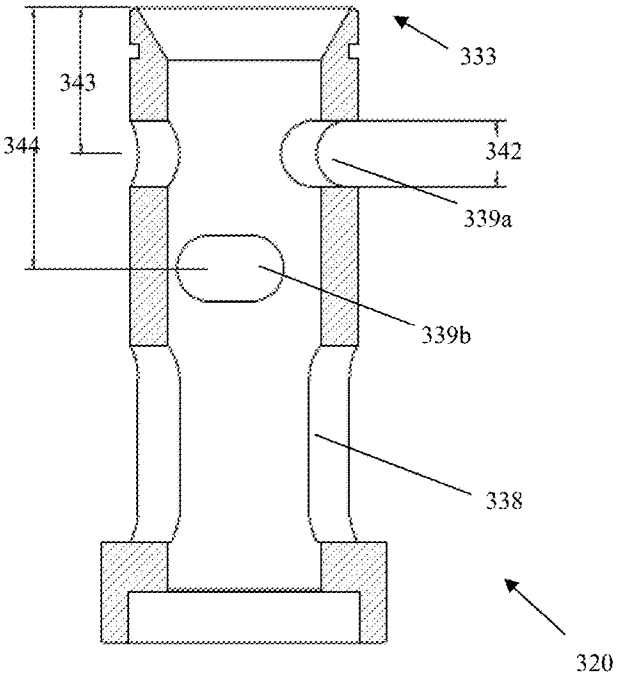
Figure 8B:
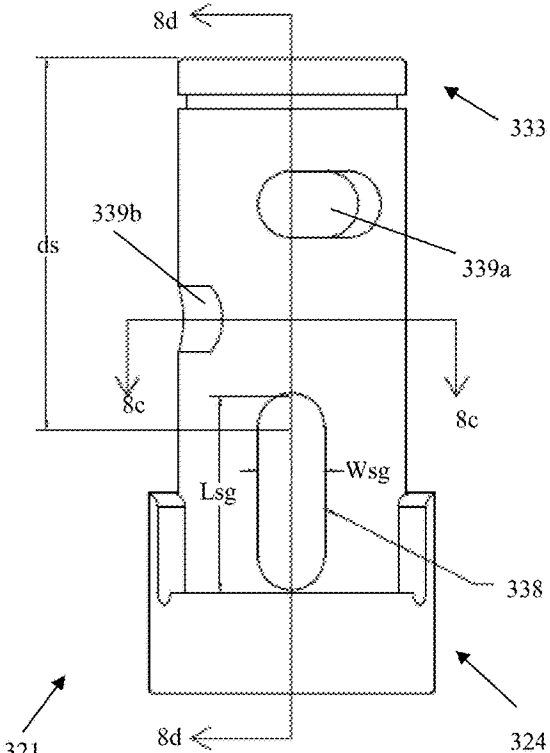

With reference to FIG. 8*b*, in one or more embodiments, the lower section 321 is illustrated from a side view. The lower section 321 may have a slot 338 that may be the grout port, as described above in FIG. 6*d*. The slot 338 extends a length Lsg from the base 324 and has a width Wsg. In a non-limiting example, the slot 338 may have the shape of an ellipse or elongated oval placed a distance ds from the top end 333. Additionally, the lower section 321 may have a plurality of connection holes 339*a*, 339*b* such that there is an upper connection hole 339*a* and a lower connection hole 339*b*. In FIG. 8*c*, in one or more embodiments, a cross-sectional view taken along line 8*c*-8*c* on the lower section 321 in FIG. 8*b* is illustrated. One skilled in the art will appreciate how the cross-sectional view along line 8*c*-8*c* illustrates an offset angle 340 of the connection holes 339*a*, 339*b* from a central axis 341 of the slot 338. In FIG. 8*d*, in one or more embodiments, a cross-sectional view taken along line 8*d*-8*d* on the lower section 321 in FIG. 8*b* is illustrated. The upper connection hole 339*a* is shown with a size 342 at a distance 343 from the top end 333. Furthermore, the lower connection hole 339*b* is at a distance 344 from the top end 333 to be below the upper connection hole 339*a*.

Figure 9C:
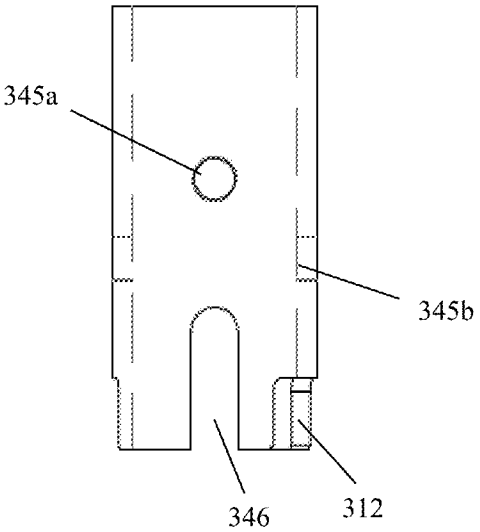
FIGS. 9*a*-9*g* are views of an upper section of a grout coupler of the pressure grouted screw pile system of FIG. 5*a* in accordance with the present disclosure.
Figure 9F:
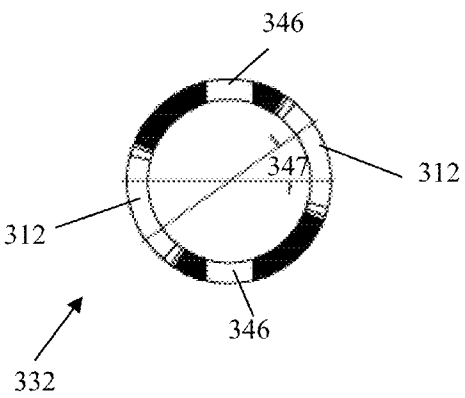
Figure 9B:
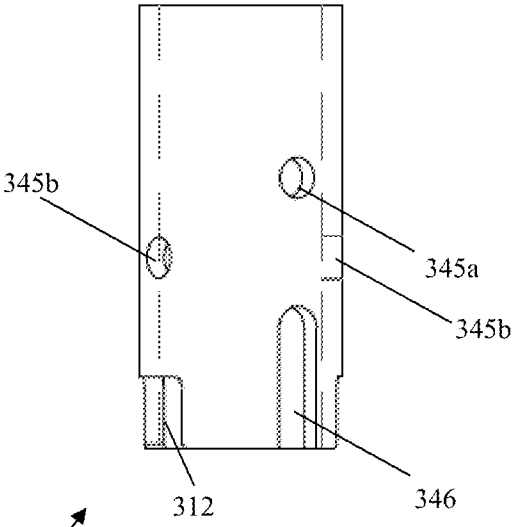
Figure 9E:
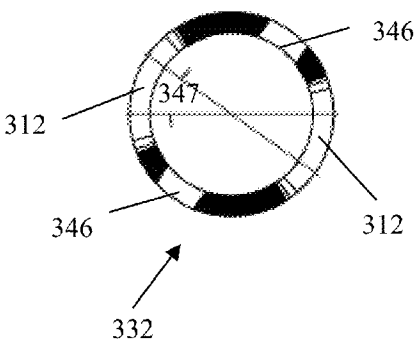
Figure 9A:
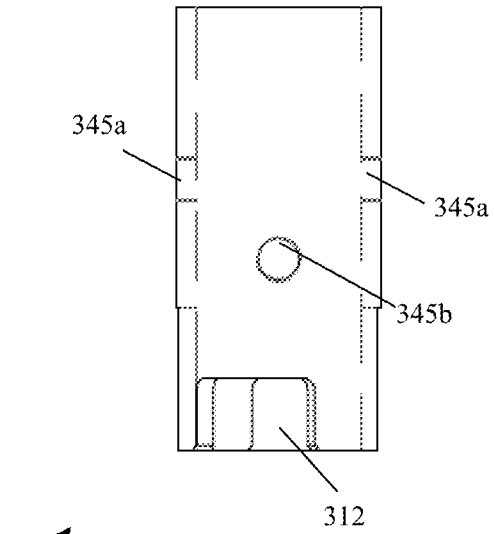
Figure 9D:
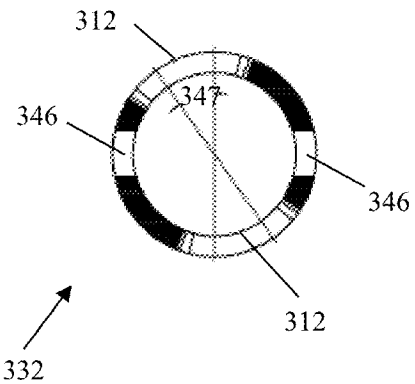

Referring to FIGS. 9*a*-9*g*, in one or more embodiments, the upper section 332 of the grout coupler (320) is illustrated. In FIG. 9*a*, the upper section 332 is illustrated from a side view. Additionally, FIG. 9*b* illustrates a side view of the upper section 332 45 degrees from the side view of FIG. 9*a* and FIG. 9*c* illustrates a side view of the upper section 332 90 degrees from the side view of FIG. 9*a*. The upper section 332 may have a plurality of holes (345*a*, 345*b*) to align with the connection holes (339*a*, 339*b*) of the lower section (321). The plurality of holes may have two upper holes 345*a* and two lower holes 345*b* to align with the upper holes (339*a*) and the lower holes (339*b*) of the lower section (321), respectively. One skilled in the art will appreciate that with the holes (345*a*, 345*b*) of the upper section 332 aligned with the connection holes (339*a*, 339*b*) of the lower section (321), the bolts and screws (282) may be inserted into the holes to couple the grouting module (200) to the bottom pile extension (260*a*). Additionally, the upper section 332 may include cut-outs 312 and slots 346 at the bottom of the upper section 332. In a non-limiting example, the slots 346 may align with the slots (338) of the lower section (321) to form a grouting port to discharge grout above the cone (279). It is further envisioned that the upper section 332 may be raised, turned, and lowered, such as in connection with other alignment mechanisms (not shown), such that when the upper section 332 is disposed on the lower section (321), the slots 346 of the upper section 332 do not align with slots (338) of the lower section (321). By having the slots (346, 338) out of alignment, grout will not discharge above the cone (279), such that the grout may be able to flow from the grouting module (200) into the axial passageway (300) of the auger shaft (270) to flow out the bottom discharge flowbores (i.e., grouting ports 271). In some embodiments, FIGS. 9*d*-9*f* illustrate a bottom view of FIGS. 9*a*-9*c*, respectively. In FIGS. 9*d*-9*f*, the cut-outs 312 may have two axis of offset at an angle 347.

Figure 9G:
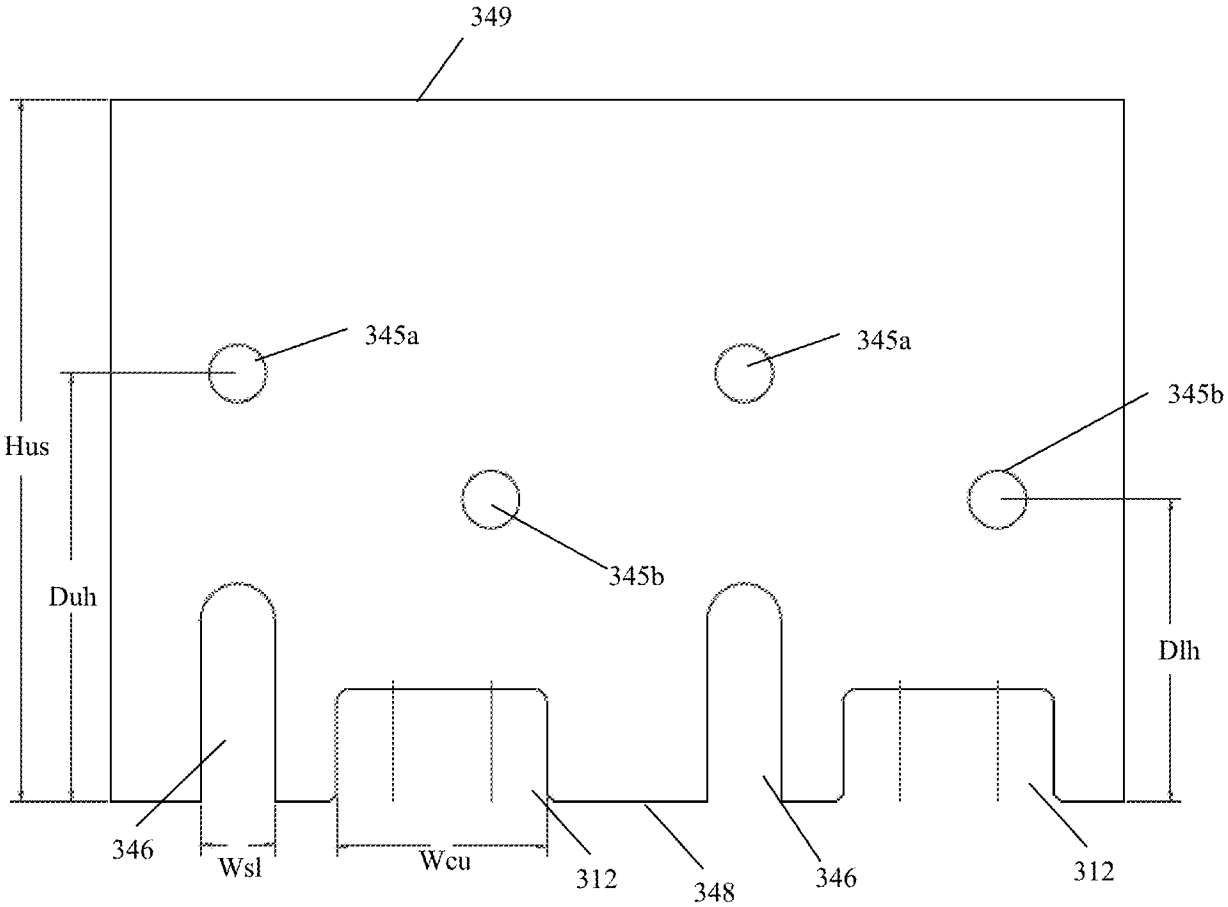

Now referring to FIG. 9*g*, in one or more embodiments, the upper section 332 is illustrated a flat plate for clarity purposes only. In a non-limiting example, the upper section 332 may have a height Hus from a bottom end 348 to a top end 349. Additionally, the upper holes 345*a* may be at a distance Duh from the bottom end 348 and the lower holes 345*b* may be at a distance Dlh from the bottom end 348 such that the lower holes 345*b* sit closer to the bottom end 348 than the upper holes 345*a*. Further, the cut-outs 312 may have a width Wcu which is larger than a width Wsl of the slots 346.

In another aspect, the present disclosure relates to a method of installing a pressure grouted screw pile. The method may include installation components of a screw pile system into a substrate at a pile location, forming an annular space around the components, and injecting grout into the annular space.

The method may include some or all of the steps described below. The method may use the components of the screw pile system described above. A grouting module used in the method may have features described above.

With reference to FIGS. 1*a*-9*g* an auger shaft 270 may be advanced into a substrate 290 at a pile location. In some embodiments, the auger shaft 270 may be driven by an auger drive motor. The auger drive motor may be supported by the boom of a conventional skid-steer or excavator. The boom and the auger drive motor may be raised to a height above the surface 292 of the substrate 290, such that the height is greater than or about equal to the length of the auger shaft 270. The auger shaft 270 may be attached to the auger drive motor, such that the auger shaft 270 is vertical and a tip 274 of the auger shaft 270 is oriented towards the substrate 290. In some embodiments, the auger shaft 270 may be attached to the auger drive motor via a drive head 256 and drive connector 258. The auger drive motor may be lowered such that the tip 274 contacts the surface 292 of the substrate 290. The auger shaft 270 may be rotated via the drive motor and downward force may be applied to the auger shaft 270 as it is rotated.

The auger shaft 270 may be advanced into the substrate 290, such that a portion of the auger shaft 270 extends above the surface 292 of the substrate 290. The drive head 256 and/or the auger drive motor may be disconnected from the auger shaft 270 via the drive connector 258.

The grouting module 200 may be attached to the exposed end of the auger shaft 270. A lower adapter 106 of the grouting module 200 may be attached to the auger shaft 270. Advancing the grouting module 200 and the auger shaft 270 into the substrate may include attaching the drive head 256 and/or the auger drive motor to the grouting module 200, and rotating and applying downward force to the auger shaft 270 and the grouting module 200. In some embodiments, the grouting module may be attached to the auger shaft 270 before the auger shaft 270 is driven into the substrate 290.

The boom and the auger drive motor may be raised to a height above the upper surface 110 of the grouting module 200, such that the height is greater than or about equal to the length of a hollow pile shaft extension 260. A hollow pile shaft extension 260 may be attached to the grouting module 200. The hollow pile shaft extension 260 may be attached to an upper adapter 104 of the grouting module 200.

The drive head 256, a grouting connector 254, and the auger drive motor may be attached to the hollow pile shaft extension 260 via the drive connector 258. The hollow pile shaft extension 260, the grouting module 200, and the auger shaft 270 may be driven into the substrate 290. Pile advancement may comprise rotating and/or applying downward force to the hollow pile shaft extension 260, the grouting module 200, and the auger shaft 270.

As the hollow pile shaft extension 260, the grouting module 200, and the auger shaft 270 are advanced into the substrate 290, an annular space 294 may be formed around the grouting module 200 and the hollow pile shaft extension 260. In some embodiments, the annular space 294 may be formed by a flange 120 of the grouting module 200.

The hollow pile shaft extension 260, the grouting module 200, and the auger shaft 270 may be driven into the substrate 290 such that a lip 126 of the grouting module 200 is an adequate grout start depth d below the surface 292 of the substrate 290 before pressure grouting is commenced. This depth will be sufficient to minimize the risk of grout from migrating to the surface 292 of the substrate as the pile is pressure grouted concurrent with advancement. In some embodiments, this depth d may be between one and ten feet, between two and six feet, or about four feet, for example.

Grout may be injected into a flowbore of the hollow pile shaft extension 260. In some embodiments, the grout may be injected into the hollow pile shaft extension 260 from a pump connected to the hollow pile shaft extension 260 via a grouting swivel 254 and a flowline 252. The grout may flow through the flowbore of the hollow pile shaft extension 260 and into the axial flowbore 114 of the grouting module 200. The grout may flow through the axial flowbore 114, the flow chamber 116, and the injection conduits 118 of the grouting module 200. The grout may be injected into the annular space 294 above the lip 126 from the injection conduits 118.

Grout may be prevented from backflowing from the annular space 294 into the grouting module 200. A check valve (not shown) may prevent grout from flowing backwards through the flow path described in the previous paragraph. The check valve may prevent the flow of grout from the annular space 294 into the grouting module 200. By preventing flow of grout from the annular space 294 into the grouting module 200, the check valve may maintain grout pressure within the annular space 294. Maintaining pressure within the annular space 294 may prevent movement of the grout within the annular space and may ensure the grout remains in an even annulus having a constant or near-constant outer diameter around the pile shaft extensions 260. The check valve may be disposed within the grouting module 200, the hollow pile shaft extension 260, or a component (not shown) connected between the grouting module 200 and the hollow pile shaft extension 260. The check valve may provide further advantages to the screw pile system 200 as described below.

Grout may be prevented from flowing to the surface 292 of the substrate 290 through the annular space 294. Substrate material 290 surrounding the annular space 294 above the grout start depth d may fill in the annular space 294, such that grout may not flow into the space and to the surface 292 of the substrate. The grout start depth d may be the depth to which the lip 126 of the grouting module 200 is advanced until injection of grout begins. In some embodiments, other means may be used to prevent the flow of grout to the surface 292 of the substrate 290 through the annular space 294, such as a specialized plate which remains at the surface 292 of the substrate through which the pile is advanced.

The hollow pile shaft extension 260, the grouting module 200, and the auger shaft 270 may be driven into the substrate 290 such that a small portion of the pile shaft extension 260 extends above the surface 292 of the substrate 290. The drive head 256, the grouting swivel 254, and/or the auger drive motor may be disconnected from the hollow pile shaft extension 260.

The boom and the auger drive motor may be raised to a height above the exposed end of the hollow pile shaft extension 260, such that the height is greater than or about equal to the length of the next hollow pile shaft extension 260 that is to be advanced in to substrate 290 in order to install the pile to the desired tip depth. A second hollow pile shaft extension 260 may be attached to the first hollow pile shaft extension 260. The hollow pile shaft extensions 260 may be attached via a joint 262. In some embodiments, the hollow pile shaft extensions 260 may be attached via a pile coupling 261.

The drive head 256, a grouting swivel 254, and the auger drive motor may be attached to the second hollow pile shaft extension 260 via the drive connector 258. The hollow pile shaft extensions 260, the grouting module 200, and the auger shaft 270 may be driven further into the substrate 290. Driving may comprise rotating and/or applying downward force to the hollow pile shaft extension 260, the grouting module 200, and the auger shaft 270. As the hollow pile shaft extensions 260, the grouting module 200, and the auger shaft 270 are driven into the substrate, an annular space 294 may be formed around the hollow pile shaft extensions 260.

Grout may be injected into the second hollow pile shaft extension 260 as the hollow pile shaft extensions 260, the grouting module 200, and the auger shaft 270 are driven into the substrate 290. The grout may flow into the annular space 294.

The hollow pile shaft extensions 260, the grouting module 200, and the auger shaft 270 may be driven into the substrate 290 such that a small portion of the second pile shaft extension 260 extends above the surface 292 of the substrate 290. The drive head 256, the grouting swivel 254, and/or the auger drive motor may be disconnected from the uppermost hollow pile shaft extension 260. Injection of grout may again be stopped. The process then continues by installation and driving of additional extensions 260, where pumping of the pressurized grout resumes when advancement is resumed, thus completely filling the annular space 240 as the pile is advanced.

These steps may be repeated any number of times until the pressure grouted screw pile is installed to a desired tip depth.

Flow of grout from the annular space 294, either into the grouting module 200 or to the surface 292 of the substrate 290 may be prevented as described above, while each additional pile shaft extension 260 is attached to the previous pile shaft extension 260 and the grout pumping and pressurization is temporarily halted. Preventing flow of grout from the annular space 294 into the grouting module 200 or to the surface 292 of the substrate 290, and resumption of grout injection upon re-start of rotation/advancement may prevent thin necks from forming in the grout section surrounding the hollow pile shaft extensions 260. Necks in the grout are undesirable, as providing points weak spots at which a pile is more likely to fail. Therefore, preventing the formation of necks may prevent failure of the pressure grouted screw pile. The method as described above may provide a uniform and complete fill of grout within the annular space 294.

When the pressure grouted screw pile is at the desired depth, grout may be injected into the uppermost hollow pile shaft extension 260, such that the flowbores of the hollow pile shaft extensions 260 are filled with grout. The grouting swivel 254, drive head 256, and the auger drive motor may be disconnected from the uppermost hollow pile shaft extension 260 via the drive connector 258. The grout in the annular space 294 and the flowbores of the hollow pile shaft extensions 260 may be allowed to harden. In some embodiments, the grout may harden in twenty minutes to ten hours, one to three hours, or ninety minutes to two hours, for example. The length of time necessary for the grout to harden may depend on the depth of the pressure grouted screw pile, the diameters of the annular space and flowbores, the composition of the grout, or other properties of the system, grout, substrate, or environment.

In some embodiments, grout may be injected around the auger shaft 270 when the screw pile 250 is at the desired depth. In such embodiments, grout may be prevented from flowing into the auger shaft during the steps described above. After completion of the steps described above, or a subset of those steps, if not all steps are performed, grout may be allowed to flow into the auger shaft 270. Grout may also be prevented from flowing out of a side or flange of the grouting module 200.

In some embodiments, as shown in FIGS. 2*a*-2*c*, preventing grout from flowing into the auger shaft 270 may comprise maintaining the grouting module 200 in a first configuration in which a flowbore of the upper adapter 104 is aligned with a side discharge flowbore 114*a* of the body 102. Allowing grout to flow into the auger shaft 270 may comprise rotating the upper adapter 104 relative to the body 102, such that the flowbores of the upper adapter 104 are aligned with bottom discharge flowbores 114*b* of the body 102.

Grout may flow from the bottom discharge flowbores 114*b* into the auger shaft 270. In some embodiments, grout may flow through an axial flowbore (not shown) which may extend along the length of the auger shaft 270. Grout may exit the auger shaft via grouting ports 273 formed along the length of the auger shaft 270. Grout may be injected into the pile shaft system 250 at sufficient pressure to displace substrate 290 around the auger shaft 273. Grout may be injected such that a desired volume of grout is disposed below and/or around the auger shaft 273.

In some embodiments, the upper adapter of the grouting module and the upper pile shaft extensions 260 may be counter-rotated to realign the ports in the grouting module from side discharge in the annular space around the pile shaft, to bottom discharge through the lead pile extension.

In some embodiments, a control system may be used to measure properties of the screw pile installation system during the installation process and to control aspects of the installation process. The control system may be used to perform quality control and/or quality assessment operations. The control system may include sensors installed on components of the system, in the substrate, or in the surrounding environment, which measure properties of the system during installation. Measured properties may be used to calculate other properties. In some embodiments, some or all of the following properties may be measured or calculated: flow rate of the grout; torque and drive rate of the auger drive motor; resistance experienced by the auger shaft; depth of the auger shaft tip, grouting module, and/or other known component of the system; rate of change in the depth; density of the substrate; and diameter of the annular space. These properties may or may not be measured in real-time.

Measurements of properties may be communicated to a processor. The processor may calculate further properties based on the measurements, store the measurements, command operations of the system based on the measurements, and/or perform other functions. The control system may use wireless or non-wireless communication. Measurements or other information may be displayed to a human operator and the human operator may input commands based on the di splayed information.

The control system may be configured to ensure that grout is injected into the annular space, such that the grout completely fills the volume of the annular space as it is driven, and may result in a fairly uniform or constant diameter of grout after it hardens. The rate of downward travel of a component of the system may be measured. Alternatively, or additionally, the resistance experienced by the auger shaft or another property may be measured and a rate of downward travel of the system may be calculated based on the resistance. An injection rate of the grout may be controlled based on the rate of downward travel and the resulting volume of the annular space. Alternatively, or additionally, a torque or rotational speed of the auger drive motor may be controlled based on the rate of downward travel. Such a process may be particularly advantageous when a pressure grouted screw pile is installed in a substrate including different materials at different depths.

In some embodiments, a control system may be used to track a fill rate of the annular space. The inner and outer diameters of the annular space may be known based on the outermost diameter of the flange and the outer diameter of the hollow pile shaft extensions. The depth of the annular space may be calculated based on a drive rate of the drive means, a total number of piles installed, a depth of a known component of the system, and/or a resistance experienced by the auger shaft. The diameters and the depth of the annular space may be used to calculate a volume of the annular space. The injection rate of the grout may also be known based on the measurements of the system. A volume of grout injected may be calculated based on the injection rate. The control system may command an injection rate of the grout based on the volume of the annular space. The control system may display a comparison of the total volume of the annular space at a given time and the total injection volume of the grout. This comparison may allow potential locations of necks in the grout to be identified and may allow necks to be identified and corrected during the installation process, such as by additional pumping of grout after rotation of the drive is stopped prior to installation of a subsequent pile extension.

The grouting module, installation system, installation method, and pressure grouted screw pile in accordance with the present disclosure may have advantages over the current state of the art. A pressure grouted screw pile may have advantages of both driven piles and screw piles while minimizing the less desirable features present in each.

Installation of the pressure grouted screw pile may be relatively easy, quick, inexpensive, and safe. Installation may be performed using a skid-steer or an excavator, and the boom of either piece of equipment may not have to be raised beyond about the height of the hollow pile shaft extensions. This may require less space and personnel than are used for installation of driven piles. Because installation is performed by rotating components instead of driving components directly, the installation process may disrupt the surrounding environment minimally. Further, liquid grout may surround significant portions of the system during installation, and may decrease friction along the pile shaft during advancement allowing for deeper pile penetration for a given torque.

Pressure grouted screw piles may also have advantages during use. Pressure grouted screw piles may have improved compressive capacity compared to traditional screw piles. Pressure grouted screw piles may be less prone to installation and quality control issues than other types of foundation piles, especially auger cast piles. As described above, preventing flow of grout out of the annular space may prevent necks from forming. Necks may be particularly prone to failure. Therefore, preventing the formation of necks may result in a pile which is less prone to cracking or failing by other mechanisms. This may improve the safety of structures supported by pressure grouted screw piles.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed is:

1. A grouting module, comprising:

a lower surface configured for connection to a screw pile component;

an upper surface configured for connection to an upper hollow pile shaft;

a body disposed between the upper surface and the lower surface;

an upper adapter disposed between the body and the upper surface;

a lower adapter disposed between the body and the lower surface;

an axial bore through the upper surface and at least a portion of the body;

wherein the body comprises:

a widened flange configured to create an annular space around the upper adapter;

one or more flow injection conduits configured for injecting grout received from the upper hollow pile shaft through the axial bore into the annular space while the pile is advanced downward into a substrate;

wherein outlets of the one or more flow injection conduits are formed on an upper face of the flange.

2. The grouting module of claim 1, wherein the flange has an outermost diameter greater than an outermost diameter at each of the upper and lower surfaces.

3. The grouting module of claim 1, further comprising a check valve disposed within the axial bore to maintain grout pressure within the annular space around the pile shaft while the pile is advanced into the substrate.

4. The grouting module of claim 1, wherein the flange comprises a tapered outer surface, configured to compress and uniformly densify a substrate disposed around the grouting module as the grouting module is rotated and advanced downward.

5. The grouting module of claim 1, wherein an outermost diameter of the flange is greater than an outer diameter at the upper surface.

6. The grouting module of claim 1, further comprising: one or more side discharge flowbores for passing grout from the axial flowbore to the flow injection conduits, and, one or more bottom discharge flowbores for passing grout from the axial flowbore to a bottom of the grouting module.

7. The grouting module of claim 6, further comprising an alignment feature for selectively aligning the axial bore with either the one or more side discharge flowbores or the one or more bottom discharge flowbores.

8. The grouting module of claim 7, wherein an upper adapter may be rotated relative to the body to concurrently or alternately allow flow through the one or more side discharge flowbores and the one or more bottom discharge flowbores.

9. A method of installing a pile, the method comprising:

advancement of a lead auger extension into a substrate at a pile location;

connecting a lower surface of a grouting module to a proximal end of the lead auger extension, the grouting module comprising an axial bore and a tapered outer surface configured to create an annular space around an upper portion of the grouting module;

connecting a pile shaft extension to an upper surface of the grouting module;

advancing the pile shaft extension, the grouting module, and the lead auger extension into the pile location;

flowing grout through the pile shaft extension and the grouting module, such that the grout flows out of the grouting module and fills the annular space;

stopping advancement of the pile shaft extension, the grouting module, and the lead auger extension into the pile location;

stopping flowing grout through the pile shaft extension and grouting module;

installing one or more additional pile shaft extensions on a proximal end of the pile shaft extension;

advancing the pile shaft extensions, the grouting module, and the lead auger extension into the pile location;

flowing grout through the pile shaft extensions and the grouting module, such that the grout flows out of the grouting module and fills the annular space; and flowing grout through the auger shaft, such that grout flows out of the auger shaft, while preventing grout from flowing out of the grouting module into the annular space.

10. The method of claim 9, further comprising preventing grout from back-flowing into the grouting module from the annular space through the use of a check valve system.

11. The method of claim 9, wherein flowing grout comprises controlling a flow rate of the grout and advancing the pile shaft extension, the grouting module, and the lead auger extension into the pile location using a controlled drive rate.

12. The method of claim 9, wherein:

flowing grout through the pile shaft extensions and the grouting module, such that the grout flows out of the grouting module and fills the annular space comprises aligning one or more flowbores of an upper adapter of the grouting module with one or more side discharge flowbores of a body of the grouting module, flowing grout through the auger shaft such that grout flows out of the auger shaft comprises aligning the one or more flowbores of the upper adapter with one or more bottom discharge flowbores of the body, and preventing grout from flowing out of the grouting module into the annular space comprises configuring the grouting module such that the one or more flowbores of the upper adapter are not aligned with the one or more bottom discharge flowbores of the body.

13. The method of claim 12, further comprising counter rotating the upper adapter of the grouting module and the upper pile section to concurrently or alternately realign the ports in the grouting module from side discharge in the annular space around the pile shaft, to bottom discharge through the lead pile extension.

14. A grouting module, comprising:

a tubular body having an upper portion and a lower portion;

an axial bore through at least a portion of the tubular body;

the upper portion having an outermost diameter;

the lower portion comprising a tapered outer surface having an outermost diameter greater than the outermost diameter of the upper portion;

one or more outlets fluidly connected to the axial bore and configured to direct flow from the axial bore to an exterior of the grouting module above the tapered outer surface;

a check valve disposed within the axial bore; and a system in the grouting module that allows for realignment of the side and bottom ports through counter-rotation of the pile string after the pile is advanced.

* * * * *